US010900653B2

(12) United States Patent
Van De Ven et al.

(10) Patent No.: US 10,900,653 B2
(45) Date of Patent: Jan. 26, 2021

(54) LED MINI-LINEAR LIGHT ENGINE

(71) Applicant: CREE HONG KONG LIMITED, Shatin (HK)

(72) Inventors: Antony Van De Ven, Sai Kung (HK); Wai Kwan Chan, Tai Po (HK); Chin Wah Ho, Tsuen Wan (HK)

(73) Assignee: Cree Hong Kong Limited, Shatin (HK)

( * ) Notice: Subject to any disclaimer, the term of this patent is extended or adjusted under 35 U.S.C. 154(b) by 156 days.

(21) Appl. No.: 14/070,098

(22) Filed: Nov. 1, 2013

(65) Prior Publication Data

US 2015/0124437 A1 May 7, 2015

(51) Int. Cl.
*F21V 29/507* (2015.01)
*F21S 8/00* (2006.01)
(Continued)

(52) U.S. Cl.
CPC ..... *F21V 29/507* (2015.01); *F21K 9/20* (2016.08); *F21S 8/033* (2013.01); *F21S 8/024* (2013.01);
(Continued)

(58) Field of Classification Search
CPC ..... F21V 29/507; F21V 29/70; F21V 29/75; F21V 29/763; F21V 29/767; F21V 29/77;
(Continued)

(56) References Cited

U.S. PATENT DOCUMENTS 3,589,660 A 6/1971 Dunckel
4,118,763 A 10/1978 Osteen ..... 359/833
(Continued)

FOREIGN PATENT DOCUMENTS

CN 1710323 A 12/2005
CN 2872082 2/2007
(Continued)

OTHER PUBLICATIONS

Restriction Requirement from U.S. Appl. No. 13/839,130, dated Jul. 28, 2014.
(Continued)

*Primary Examiner* — Cara E Rakowski
*Assistant Examiner* — Jessica M Apenteng
(74) *Attorney, Agent, or Firm* — Ferguson Case Orr Paterson LLP

(57) ABSTRACT

Solid state light engines are disclosed that emit a bright, non-symmetrical emission pattern, with a relatively high luminous flux and from a relatively small area. The light engines can be used in many different types and sizes of light sources, with some embodiments providing a light quantity, quality and distribution similar to conventional J-type Halogen light sources. The light engines are arranged with integral power supplies and heat management features that allow for the engines to provide high emission intensities while generating significantly less heat at the light source. This can result in significantly higher efficiency and greater life space. In some embodiments, the light can perform similarly to a halogen J-type Lamp 80 mm light tube, while generating similar or greater amounts of light. The light engines according to the present invention provide the capability to be used in low profile light fixtures.

41 Claims, 20 Drawing Sheets

(51) Int. Cl.

| | |
|---|---|
| ***F21K 9/20*** | (2016.01) |
| *F21V 15/015* | (2006.01) |
| *F21V 29/70* | (2015.01) |
| *F21S 8/02* | (2006.01) |
| *F21V 29/77* | (2015.01) |
| *F21V 29/76* | (2015.01) |
| *F21Y 113/00* | (2016.01) |
| *F21W 131/109* | (2006.01) |
| *F21V 29/75* | (2015.01) |
| *F21Y 115/10* | (2016.01) |
| *F21Y 103/10* | (2016.01) |

(52) U.S. Cl.
CPC ..... *F21V 15/015* (2013.01); *F21V 29/70* (2015.01); *F21V 29/75* (2015.01); *F21V 29/763* (2015.01); *F21V 29/767* (2015.01); *F21V 29/77* (2015.01); *F21W 2131/109* (2013.01); *F21Y 2103/10* (2016.08); *F21Y 2113/00* (2013.01); *F21Y 2115/10* (2016.08)

(58) Field of Classification Search
CPC .. F21V 15/015; F21K 9/30; F21K 9/20; F21S 8/033; F21S 8/024; F21Y 2103/10; F21Y 2115/10; F21Y 2113/00; F21W 2131/109
USPC ..... 362/235, 294, 373
See application file for complete search history.

(56) References Cited

U.S. PATENT DOCUMENTS

| | | | | |
|---|---|---|---|---|
| 4,300,185 | A | 11/1981 | Wakamatsu | 362/147 |
| 4,464,707 | A | 8/1984 | Forrest | 362/271.06 |
| 4,472,767 | A | 9/1984 | Wenman | 362/147 |
| 4,946,547 | A | 8/1990 | Palmour et al. | |
| 5,200,022 | A | 4/1993 | Kong et al. | |
| 5,335,890 | A | 8/1994 | Pryor | |
| RE34,861 | E | 2/1995 | Davis et al. | |
| 5,530,628 | A | 6/1996 | Ngai | 362/127 |
| 5,653,412 | A | 8/1997 | Martorano | |
| 5,690,415 | A | 11/1997 | Krehl | 362/125 |
| 5,823,663 | A | 10/1998 | Bell et al. | |
| 5,907,218 | A | 5/1999 | Altman et al. | |
| 5,951,150 | A | 9/1999 | Helstern | 362/293 |
| 6,190,198 | B1 | 2/2001 | Ray | |
| 6,210,025 | B1 | 4/2001 | Schmidt et al. | |
| 6,350,041 | B1 | 2/2002 | Tarsa et al. | |
| 6,435,697 | B1 | 8/2002 | Simmons | 362/219 |
| 6,536,924 | B2 | 3/2003 | Segretto | 362/247 |
| 6,667,451 | B1 | 12/2003 | Hart | 200/314 |
| 6,739,734 | B1 | 5/2004 | Hulgan | 362/243 |
| 6,914,194 | B2 | 7/2005 | Fan | |
| 7,131,747 | B1 | 11/2006 | Yates | 362/219 |
| 7,213,940 | B1 | 5/2007 | Van de Ven et al. | |
| 7,217,023 | B2 | 5/2007 | Iwasa et al. | 362/555 |
| 7,228,253 | B2 | 6/2007 | Chen | 318/11 |
| 7,267,461 | B2 | 9/2007 | Kan | |
| 7,303,310 | B2 | 12/2007 | You | |
| 7,387,410 | B2 | 6/2008 | Sibout | 362/375 |
| 7,520,636 | B2 | 4/2009 | Van Der Poel | |
| 7,540,627 | B2 | 6/2009 | Handsaker | 362/225 |
| 7,559,672 | B1 | 7/2009 | Parkyn et al. | |
| 7,591,578 | B2 | 9/2009 | Chang | |
| 7,628,506 | B2 | 12/2009 | Verfuerth et al. | 362/218 |
| 7,654,703 | B2 | 2/2010 | Kan et al. | 362/362 |
| 7,674,005 | B2 | 3/2010 | Chung | 362/147 |
| 7,722,220 | B2 | 5/2010 | Van de Ven et al. | |
| 7,758,207 | B1 | 7/2010 | Zhou | 362/217.1 |
| 7,791,061 | B2 | 9/2010 | Edmond et al. | |
| 8,058,088 | B2 | 11/2011 | Cannon et al. | |
| 8,206,004 | B2 | 6/2012 | Serak et al. | 362/217 |
| 8,220,953 | B1 | 7/2012 | Moore | 362/217.01 |
| 8,313,212 | B1 | 11/2012 | Mayer et al. | 362/219 |
| 8,317,369 | B2 | 11/2012 | McCanless | 362/368 |
| 8,342,714 | B1 * | 1/2013 | Rea | F21V 11/183 362/264 |
| 8,360,599 | B2 | 1/2013 | Ivey | |
| 8,376,578 | B2 | 2/2013 | Kong | 362/241 |
| 8,388,180 | B2 | 3/2013 | Chang et al. | |
| 8,459,824 | B1 | 6/2013 | Esmailzadeh et al. | 362/147 |
| 8,476,836 | B2 | 6/2013 | Van de Ven et al. | |
| 8,523,383 | B1 | 9/2013 | Grigore et al. | 362/221 |
| 8,678,611 | B2 | 3/2014 | Chu | 313/110 |
| 8,714,770 | B2 | 5/2014 | Kato | 362/217.06 |
| 8,764,220 | B2 | 7/2014 | Chan et al. | 362/217.02 |
| 8,777,448 | B2 | 7/2014 | Shimizu | 362/235 |
| 8,888,314 | B2 | 11/2014 | Gill | |
| 9,057,493 | B2 | 6/2015 | Silmon | |
| 2001/0048599 | A1 | 12/2001 | Hess | 362/290 |
| 2004/0240214 | A1 | 12/2004 | Whitlow et al. | 362/373 |
| 2004/0252521 | A1 | 12/2004 | Clark | 362/554 |
| 2005/0041418 | A1 | 2/2005 | Fan | 362/217.05 |
| 2005/0146867 | A1 | 7/2005 | Kassay et al. | 362/217 |
| 2006/0050505 | A1 | 3/2006 | McCarthy et al. | 362/219 |
| 2006/0266955 | A1 | 11/2006 | Arvin | 250/492.1 |
| 2006/0278882 | A1 | 12/2006 | Leung | 257/98 |
| 2007/0109330 | A1 | 5/2007 | Brown Elliott et al. | |
| 2007/0158668 | A1 | 7/2007 | Tarsa et al. | |
| 2007/0171647 | A1 | 7/2007 | Artwohl et al. | |
| 2007/0183148 | A1 | 8/2007 | Mayfield, III | |
| 2008/0128723 | A1 | 6/2008 | Pang | |
| 2008/0173884 | A1 | 7/2008 | Chitnis et al. | |
| 2008/0179611 | A1 | 7/2008 | Chitnis et al. | |
| 2008/0258130 | A1 | 10/2008 | Bergmann et al. | |
| 2008/0285267 | A1 | 11/2008 | Santoro | 362/224 |
| 2008/0314944 | A1 | 12/2008 | Tsai | 224/331 |
| 2009/0009999 | A1 * | 1/2009 | Wang | F21K 9/00 362/249.01 |
| 2009/0040782 | A1 | 2/2009 | Liu et al. | 362/555 |
| 2009/0046457 | A1 | 2/2009 | Everhart | 362/235 |
| 2009/0161356 | A1 | 6/2009 | Negley et al. | 362/231 |
| 2009/0184333 | A1 | 7/2009 | Wang et al. | |
| 2009/0185379 | A1 | 7/2009 | Chen | |
| 2009/0207602 | A1 | 8/2009 | Reed et al. | 362/225 |
| 2009/0212304 | A1 | 8/2009 | Wang et al. | |
| 2009/0224265 | A1 | 9/2009 | Wang et al. | |
| 2009/0290345 | A1 | 11/2009 | Shaner | 362/249.01 |
| 2009/0290348 | A1 | 11/2009 | Van Laanen et al. | 362/249 |
| 2009/0296381 | A1 | 12/2009 | Dubord | 362/218 |
| 2010/0002426 | A1 | 1/2010 | Wu | 362/223 |
| 2010/0014289 | A1 * | 1/2010 | Thomas | F21V 29/763 362/235 |
| 2010/0110701 | A1 | 5/2010 | Liu | 362/373 |
| 2010/0128485 | A1 | 5/2010 | Teng | 362/294 |
| 2010/0142205 | A1 | 6/2010 | Bishop | 362/249.02 |
| 2010/0155763 | A1 | 6/2010 | Donofrio et al. | |
| 2010/0171404 | A1 | 7/2010 | Liu et al. | 313/46 |
| 2010/0214770 | A1 | 8/2010 | Anderson | 362/133 |
| 2010/0220469 | A1 | 9/2010 | Ivey et al. | 362/218 |
| 2010/0259927 | A1 * | 10/2010 | Chien | F21V 29/763 362/235 |
| 2010/0271804 | A1 | 10/2010 | Levine | |
| 2010/0271825 | A1 | 10/2010 | Black | |
| 2010/0328945 | A1 | 12/2010 | Song et al. | 362/240 |
| 2011/0006688 | A1 | 1/2011 | Shim | 315/119 |
| 2011/0007514 | A1 | 1/2011 | Sloan et al. | 362/368 |
| 2011/0013400 | A1 | 1/2011 | Kanno et al. | |
| 2011/0028006 | A1 | 2/2011 | Shah et al. | 439/39 |
| 2011/0090682 | A1 | 4/2011 | Zheng | 362/218 |
| 2011/0103043 | A1 | 5/2011 | Ago | 362/147 |
| 2011/0163683 | A1 | 7/2011 | Steele et al. | 315/192 |
| 2011/0211330 | A1 | 9/2011 | Wang | 362/20 |
| 2011/0222270 | A1 | 9/2011 | Porciatti | |
| 2011/0285314 | A1 | 11/2011 | Carney et al. | 315/294 |
| 2011/0286207 | A1 | 11/2011 | Chan | |
| 2011/0286208 | A1 | 11/2011 | Chrn | 362/217.1 |
| 2011/0310604 | A1 | 12/2011 | Shimizu | 362/235 |
| 2011/0310614 | A1 | 12/2011 | Budike, Jr. | 362/294 |
| 2012/0002408 | A1 | 1/2012 | Lichten et al. | 362/218 |
| 2012/0020109 | A1 | 1/2012 | Kim | |
| 2012/0051041 | A1 | 3/2012 | Edmond | 362/231 |
| 2012/0075857 | A1 | 3/2012 | Verbrugh | 362/249 |
| 2012/0081883 | A1 | 4/2012 | Wang | 362/101 |

(56) References Cited

U.S. PATENT DOCUMENTS

| | | | | |
|---|---|---|---|---|
| 2012/0092876 | A1 | 4/2012 | Chang | |
| 2012/0098424 | A1* | 4/2012 | Arik | F21V 15/011 315/35 |
| 2012/0120666 | A1 | 5/2012 | Moeller | 362/308 |
| 2012/0169234 | A1 | 7/2012 | Shew | 315/88 |
| 2012/0182755 | A1 | 7/2012 | Wildner | 362/555 |
| 2012/0201023 | A1 | 8/2012 | Yoneda | |
| 2012/0218757 | A1* | 8/2012 | Gill | F21V 15/015 362/235 |
| 2012/0235199 | A1 | 9/2012 | Andrews et al. | |
| 2012/0250302 | A1 | 10/2012 | Edwards | |
| 2013/0021803 | A1 | 1/2013 | Pickard | |
| 2013/0039090 | A1 | 2/2013 | Dau | 362/551 |
| 2013/0050998 | A1 | 2/2013 | Chu et al. | 362/218 |
| 2013/0093359 | A1 | 4/2013 | Hsu et al. | |
| 2013/0094224 | A1 | 4/2013 | Miyatake | |
| 2013/0094225 | A1 | 4/2013 | Leichner | 362/368 |
| 2013/0155670 | A1 | 6/2013 | Handsaker | 362/223 |
| 2013/0242548 | A1 | 9/2013 | Ter-Hovhannisyan | |
| 2013/0258616 | A1 | 10/2013 | Chao | |
| 2013/0271979 | A1 | 10/2013 | Pearson et al. | 362/235 |
| 2013/0279156 | A1 | 10/2013 | Kaule | 362/133 |
| 2013/0279180 | A1 | 10/2013 | Pearson et al. | 362/371 |
| 2013/0329425 | A1 | 12/2013 | Lowes et al. | |
| 2013/0343037 | A1* | 12/2013 | Alexander | F21V 19/0015 362/95 |
| 2014/0043802 | A1 | 2/2014 | Dings | |
| 2014/0085861 | A1 | 3/2014 | Nicolai | 362/84 |
| 2014/0104843 | A1 | 4/2014 | McCane | |
| 2014/0265809 | A1 | 9/2014 | Hussell | |
| 2014/0268748 | A1* | 9/2014 | Lay | F21V 15/01 362/235 |
| 2014/0313731 | A1 | 10/2014 | Kwak | |
| 2015/0016100 | A1 | 1/2015 | Ishii | 362/223 |
| 2015/0022999 | A1 | 1/2015 | Yu et al. | |
| 2015/0155427 | A1 | 6/2015 | Jang | |
| 2016/0025278 | A1 | 1/2016 | Camarota | |

FOREIGN PATENT DOCUMENTS

| | | | |
|---|---|---|---|
| CN | 101994939 | 3/2011 | |
| CN | 101994939 A | 3/2011 | |
| CN | 1019844284 | 3/2011 | |
| KR | 20100012997 | 12/2010 | |
| WO | WO 2008003289 | 1/2008 | F21S 4/003 |

OTHER PUBLICATIONS

Office Action from U.S. Appl. No. 13/839,130, dated Sep. 25, 2014.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet, 1 page, from www.leviton.com.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 13/829,558, dated Sep. 11, 2015.
Office Action from U.S. Appl. No. 14/252,685, dated Oct. 1, 2015.
Office Action from U.S. Appl. No. 13/958,461, dated Oct. 15, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,820, dated Oct. 30, 2015.
Office Action from U.S. Appl. No. 13/899,314, dated Nov. 13, 2015.
Response to OA from U.S. Appl. No. 13/899,314, filed Dec. 16, 2015.
Office Action from U.S. Appl. No. 13/672,592, dated Nov. 23, 2015.
Office Action from U.S. Appl. No. 14/020,750, dated Dec. 14, 2015.
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/770,389, filed Feb. 19, 2013, Lowes, et al.
U.S. Appl. No. 13/782,820, filed Mar. 1, 2013, Dixon, et al.
U.S. Appl. No. 12/873,303, filed Aug. 31, 2010, Edmond, et al.
U.S. Appl. No. 13/345,215, filed Jan. 6, 2012, Lu, et al.
U.S. Appl. No. 13/442,311, filed Apr. 9, 2012, Lu, et al.
U.S. Appl. No. 12/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
U.S. Appl. No. 13/830,698, filed Mar. 14, 2013, Durkee, et al.
U.S. Appl. No. 29/462,422, filed Aug. 2, 2013, Lay, et al.
CircalokTM conductive adhesive, 6972 and 6968, by Lord Corporation, 2 pages.
WhiteOpticstm White97 Film, Reflector Film Technical Data Sheet, WhiteOptics, LLc, New Castle, DE.
U.S. Appl. No. 11/473,089, filed Mar. 21, 2006, Tarsa, et al.
U.S. Appl. No. 13/018,291, filed Jan. 31, 2011, Tong, et al.
U.S. Appl. No. 13/671,089, filed Nov. 7, 2012, Hussell, et al.
U.S. Appl. No. 13/662,618, filed Oct. 29, 2012, Athalye, et al.
U.S. Appl. No. 13/462,388, filed Aug. 10, 2011, Athalye, et al.
U.S. Appl. No. 13/207,204, filed Aug. 10, 2011, Athalye, et al.
Office Action for U.S. Appl. No. 13/958,461; dated Jun. 17, 2016.
Office Action for U.S. Appl. No. 13/910,486; dated Jun. 23, 2016.
Office Action for U.S. Appl. No. 13/763,270; dated Jul. 15, 2016.
Office Action from U.S. Appl. No. 13/910,486; dated Mar. 1, 2016.
Office Action from U.S. Appl. No. 14/108,168; dated May 20, 2016.
Office Action from U.S. Appl. No. 14/252,685; dated May 20, 2016.
Office Action from U.S. Appl. No. 14/108,168; dated Dec. 24, 2015.
Office Action from U.S. Appl. No. 13/842,150; dated Dec. 30, 2015.
Office Action from U.S. Appl. No. 13/763,270; dated Jan. 12, 2016.
Office Action from U.S. Appl. No. 13/899,314; dated Feb. 4, 2016.
Office Action from U.S. Appl. No. 13/829,558; dated Feb. 19, 2016.
Office Action from U.S. Appl. No. 14/020,750; dated Jul. 20, 2016.
Office Action from U.S. Appl. No. 13/829,558; dated Aug. 16, 2016.
Office Action for U.S. Appl. No. 14/108,168; dated Nov. 15, 2016.
Office Action for U.S. Appl. No. 13/910,486; dated Dec. 14, 2016.
Chinese Office Action Application No. 201310236572; dated Jan. 4, 2017.
Office Action for U.S. Appl. No. 14/020,750; dated Jan. 25, 2017.
Office Action for U.S. Appl. No. 13/829,558; dated Oct. 4, 2017.
Office Action for U.S. Appl. No. 14/252,685; dated Oct. 20, 2017.
Office Action for U.S. Appl. No. 14/108,168; dated Nov. 2, 2017.
Search Report for Chinese Application No. 2013101236572; dated Jan. 22, 2018.
Fourth Office Action for Chinese Application No. 2013101236572; dated Jan. 30, 2018.
Office Action for U.S. Appl. No. 13/910,486; dated Feb. 5, 2018.
Office Action for U.S. Appl. No. 13/763,270; dated Mar. 10, 2018.
Office Action for U.S. Appl. No. 14/108,168; dated Mar. 22, 2018.
Office Action for U.S. Appl. No. 13/829,558; dated May 2, 2018.
Office Action for U.S. Appl. No. 13/910,486; dated Jun. 29, 2018.
Office Action for U.S. Appl. No. 14/252,685; dated Apr. 7, 2017.
Office Action for U.S. Appl. No. 13/829,558; dated Apr. 10, 2017.
Office Action for U.S. Appl. No. 13/910,486; dated Apr. 20, 2017.
Office Action for U.S. Appl. No. 13/763,270; dated Jun. 16, 2017.
Office Action for U.S. Appl. No. 14/108,168; dated Jun. 20, 2017.

(56) References Cited

OTHER PUBLICATIONS

Foreign Office Action for Chinese Application No. 2013101236572; dated Jul. 10, 2017.
Office Action for U.S. Appl. No. 13/910,486; dated Aug. 28, 2017.

* cited by examiner

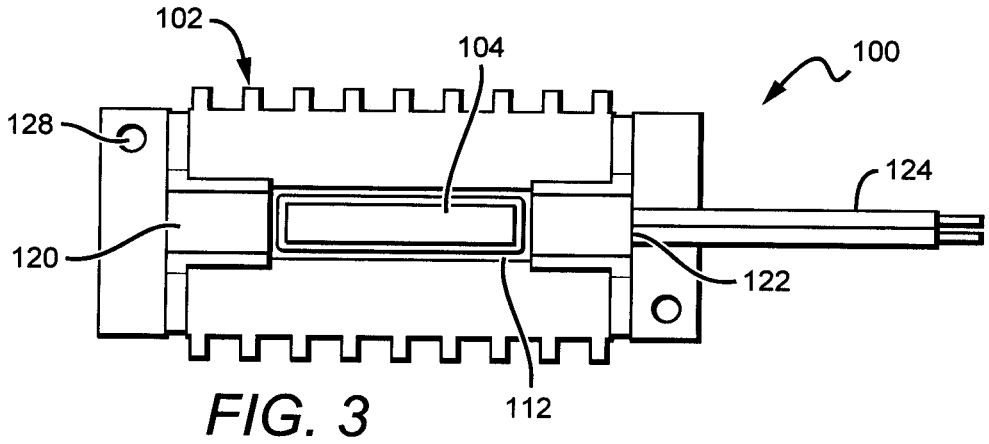
FIG. 3
FIG. 4
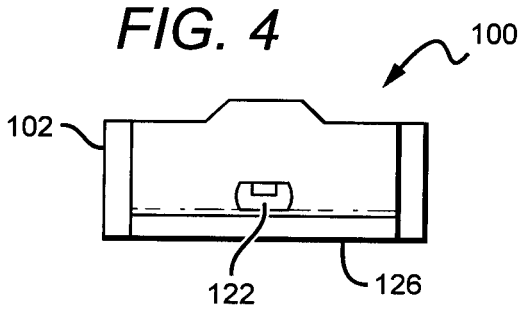
FIG. 5
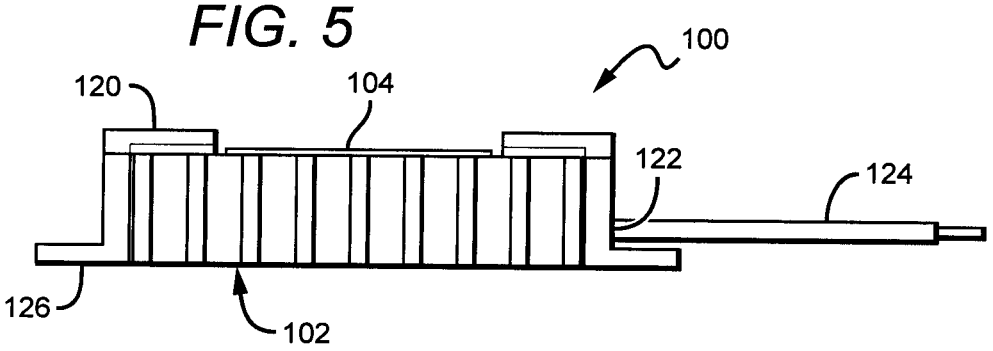
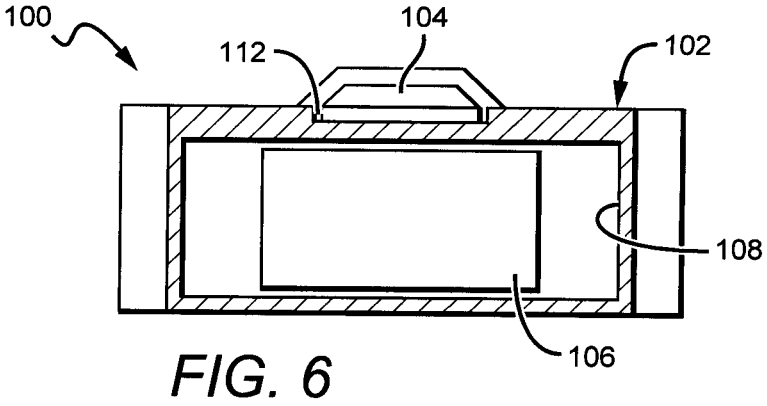
FIG. 6

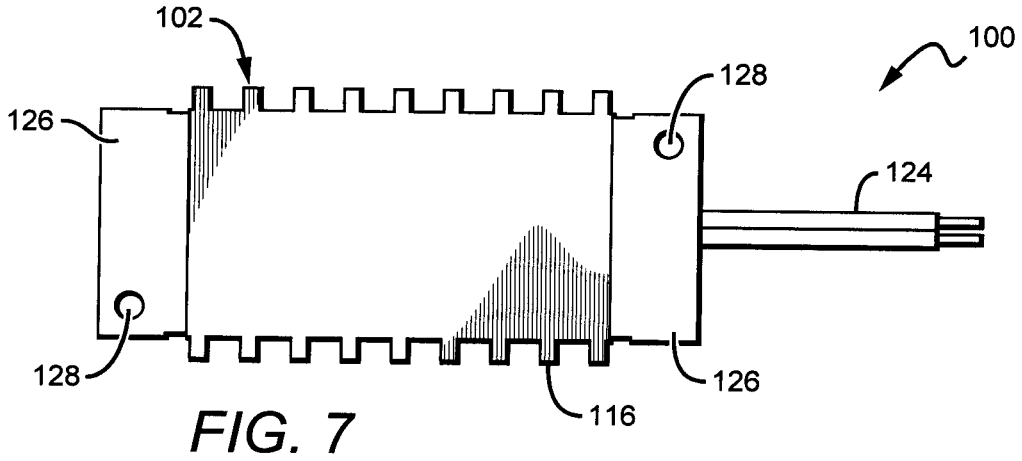
FIG. 7
FIG. 8
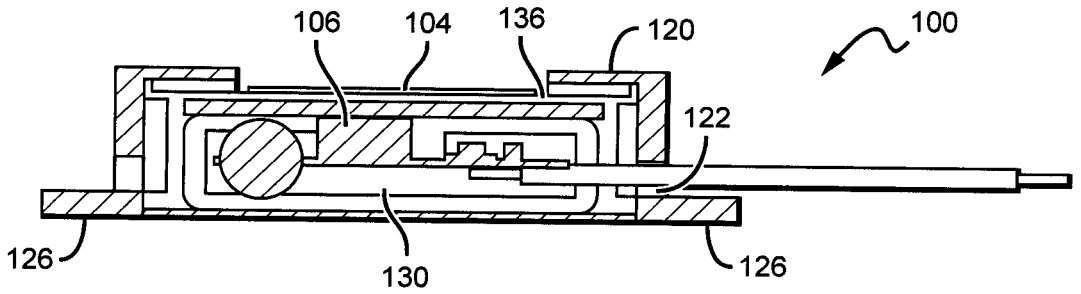
FIG. 9
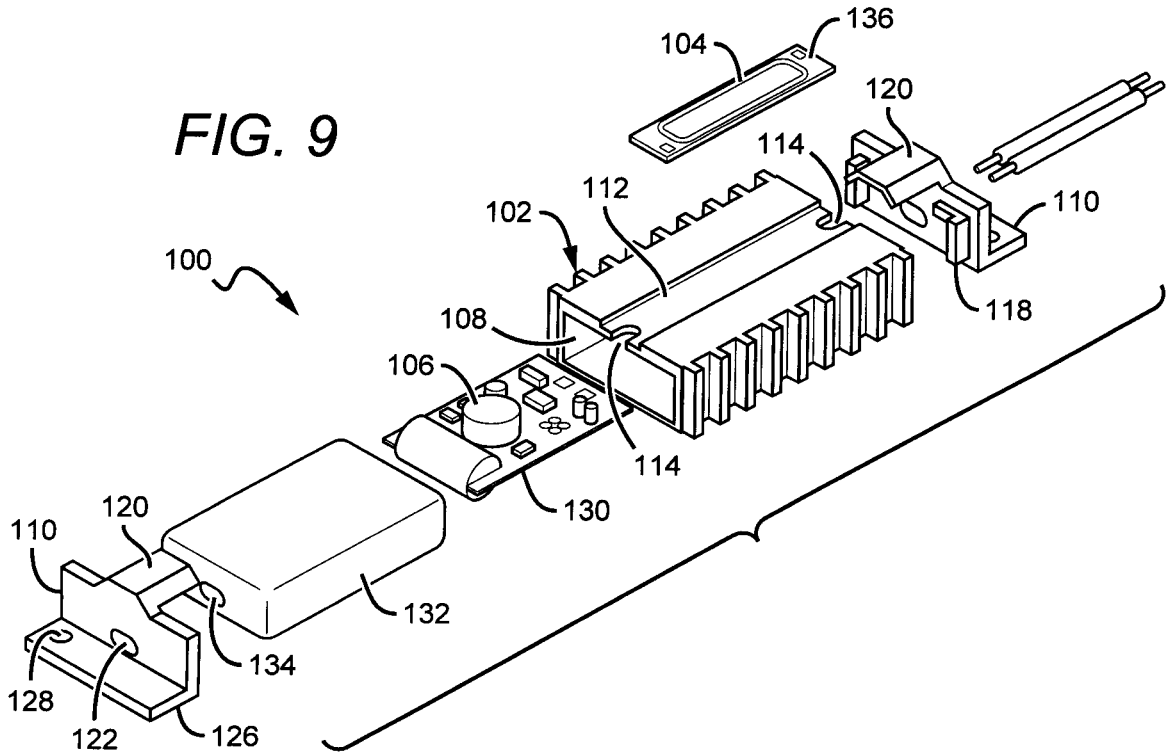

FIG. 10
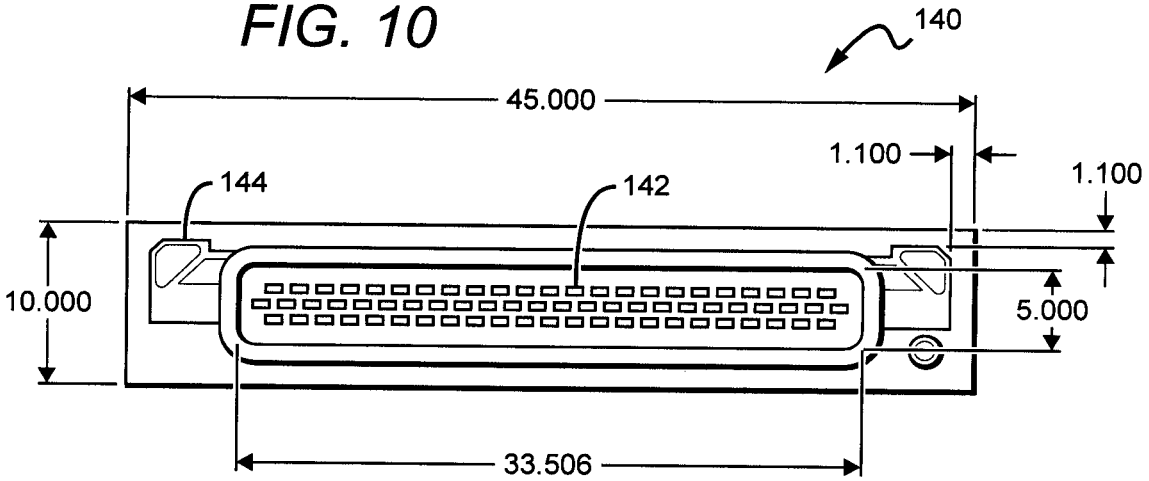
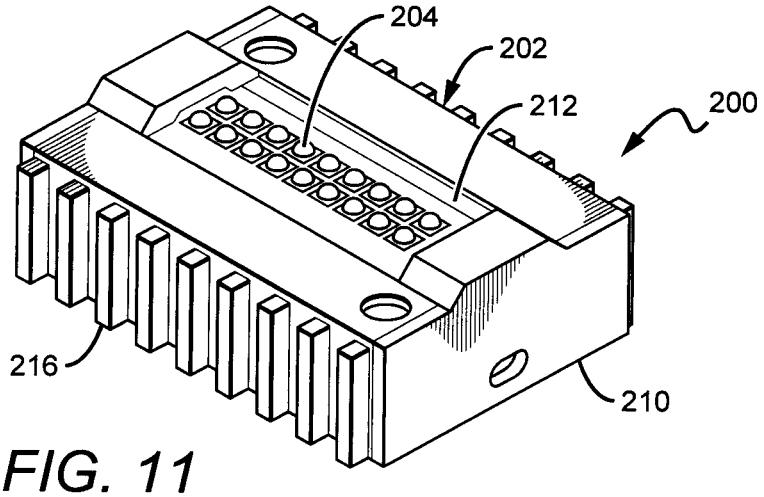
FIG. 11
FIG. 12
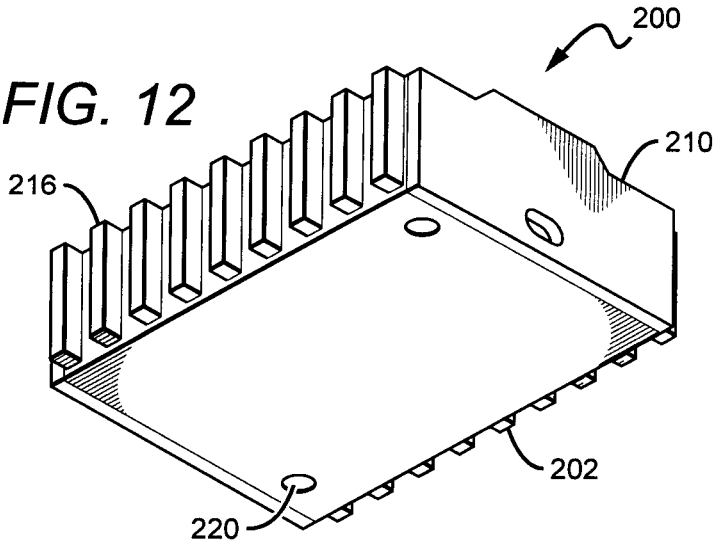

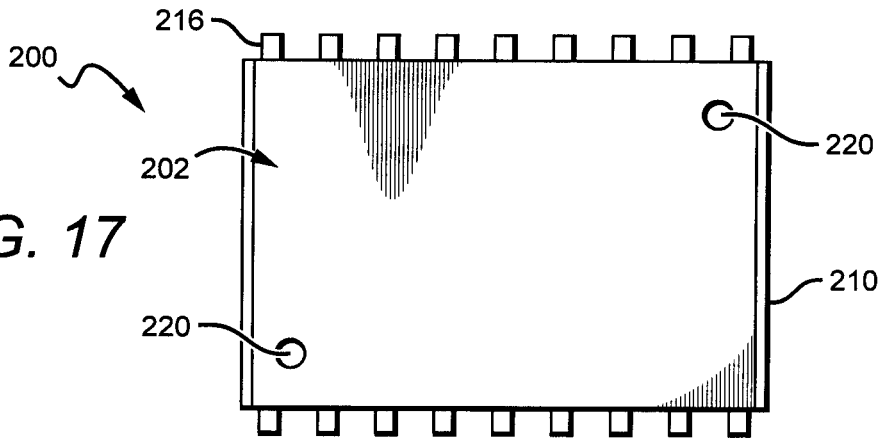
FIG. 17
FIG. 18
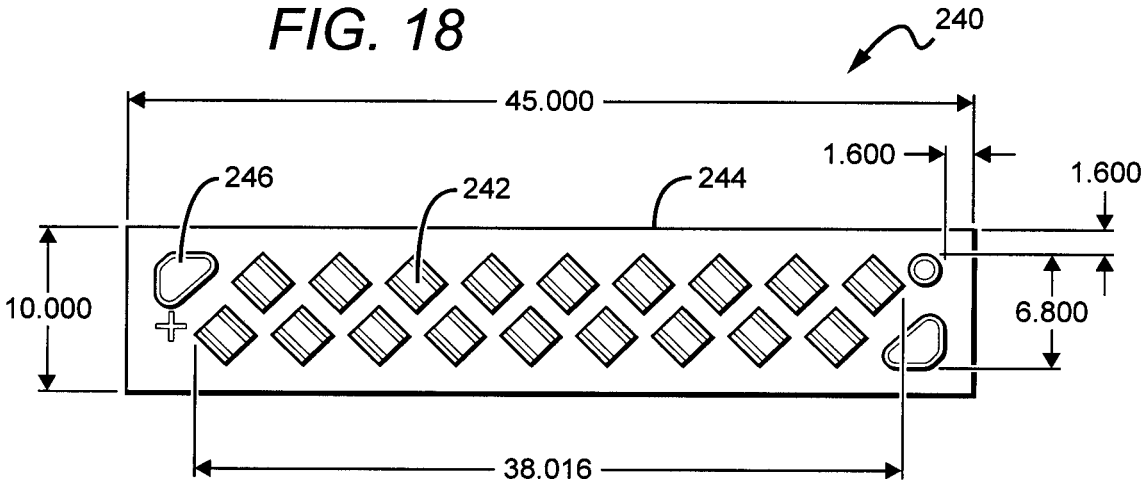
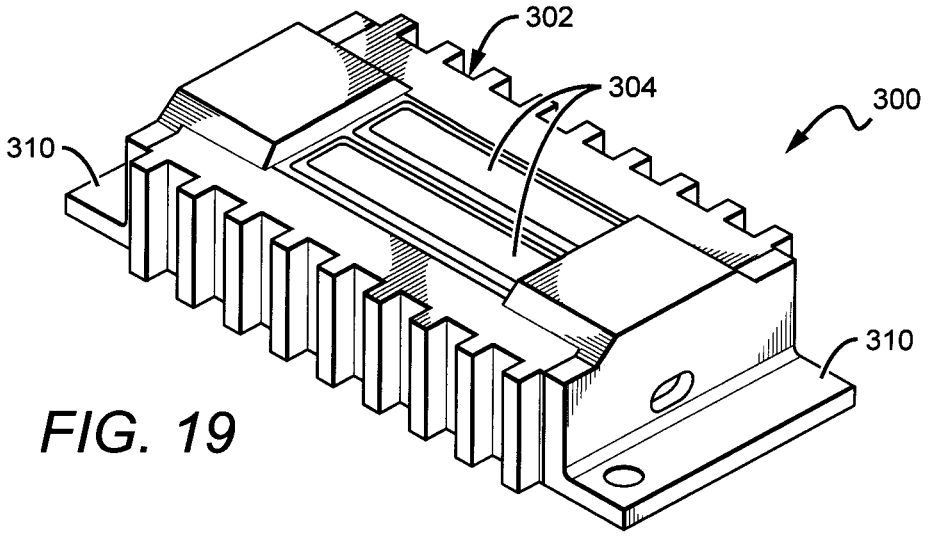
FIG. 19

FIG. 20
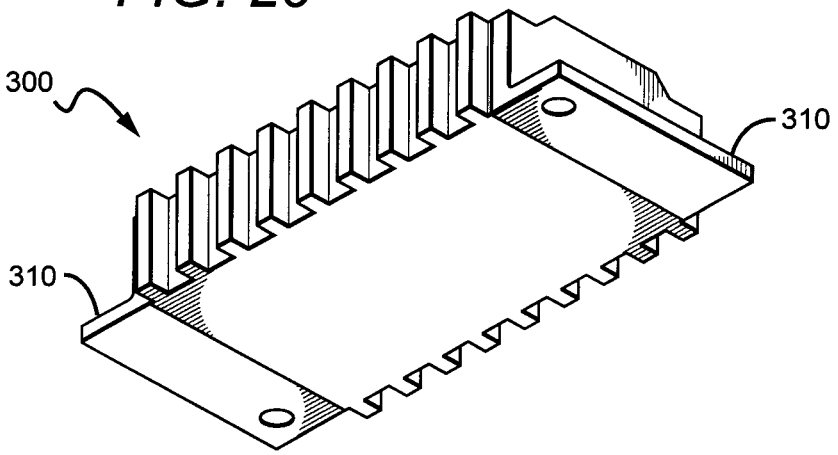
FIG. 21
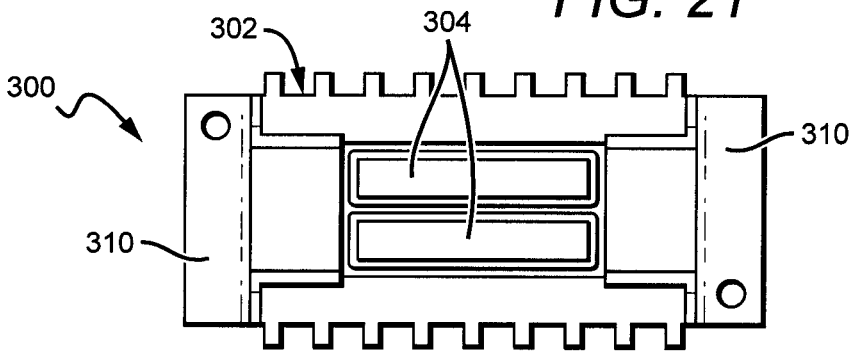
FIG. 22
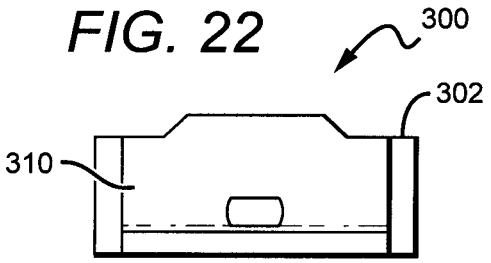
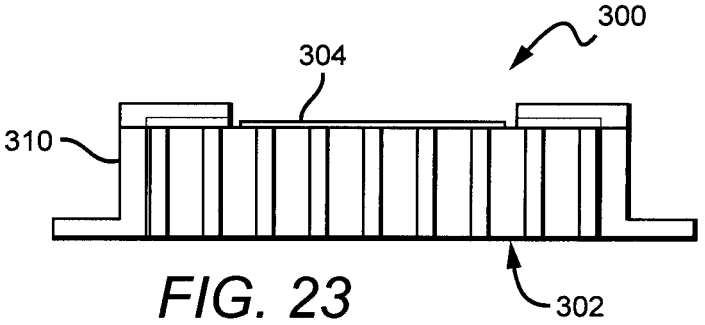
FIG. 23

FIG. 27
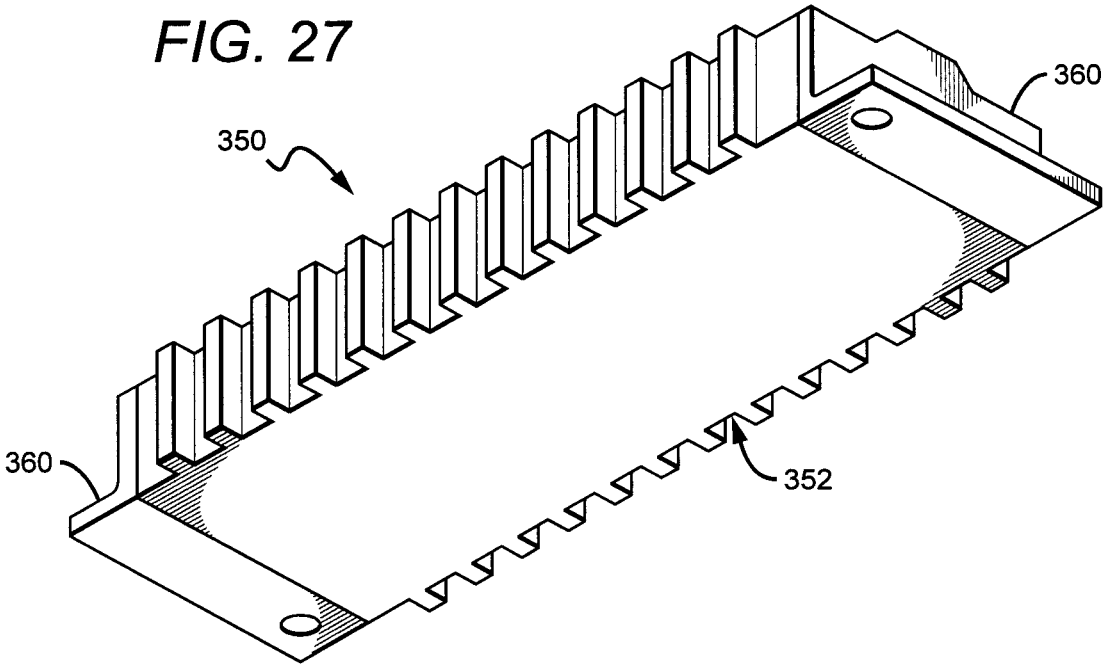
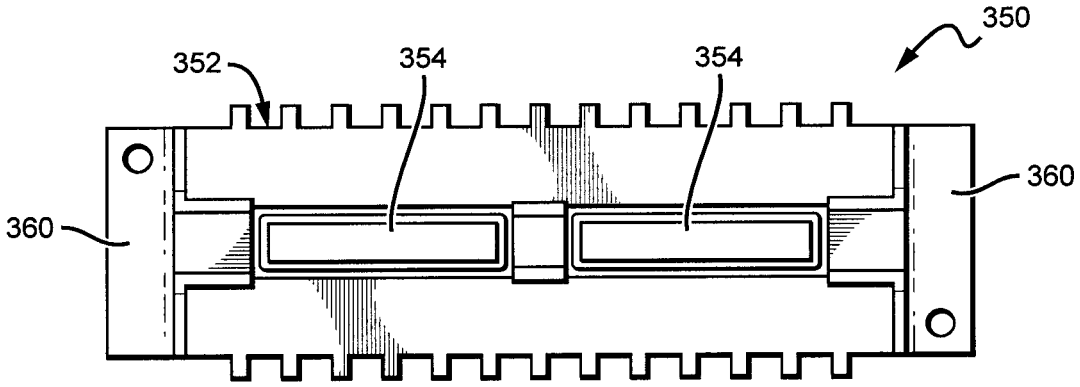
FIG. 28
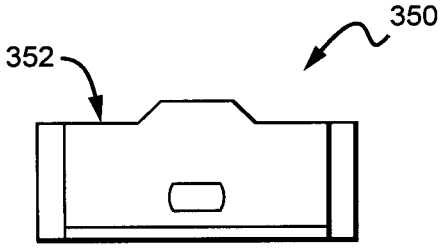
FIG. 29

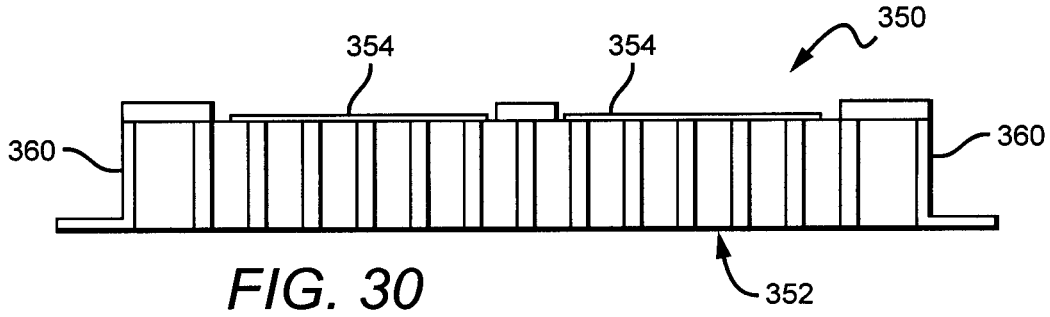
FIG. 30
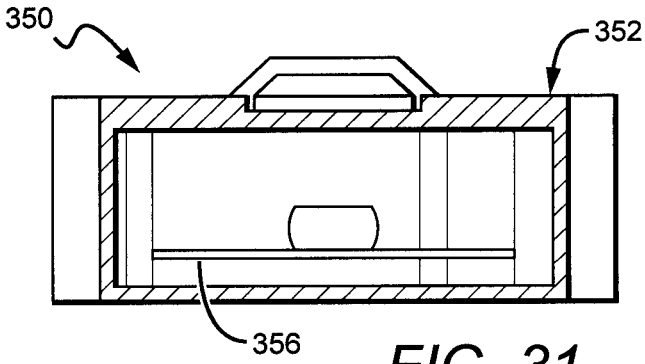
FIG. 31
FIG. 32
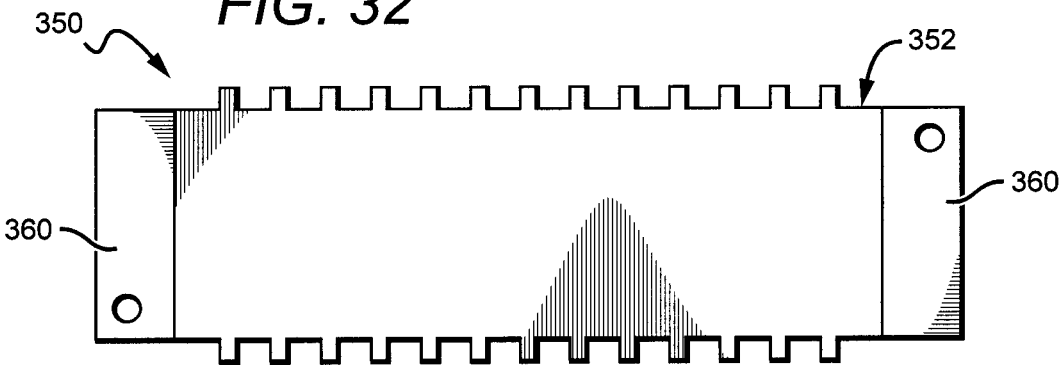
FIG. 33
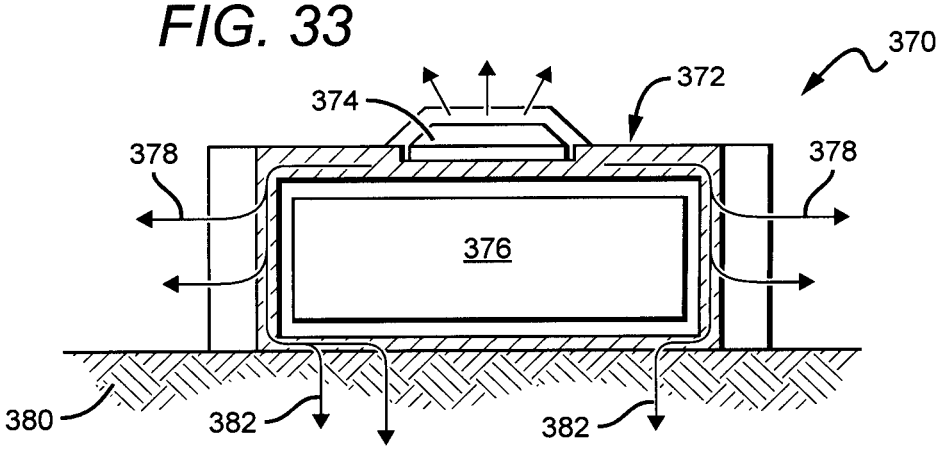

FIG. 34
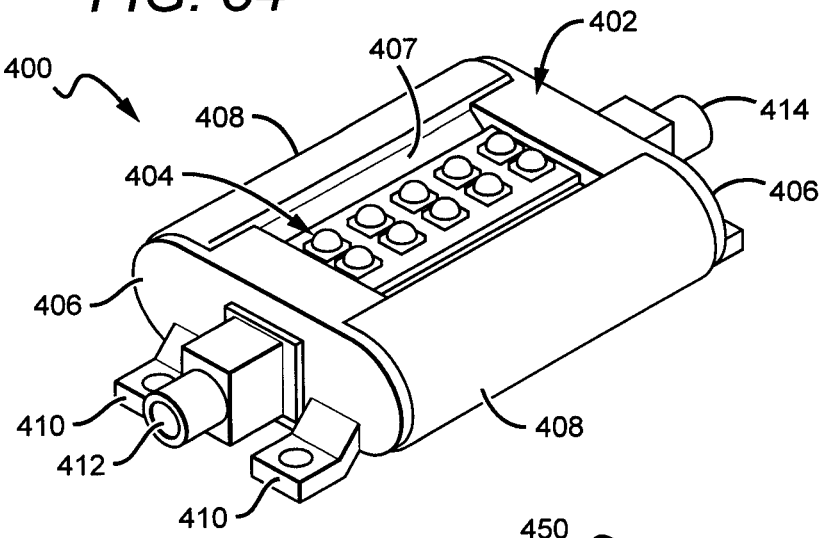
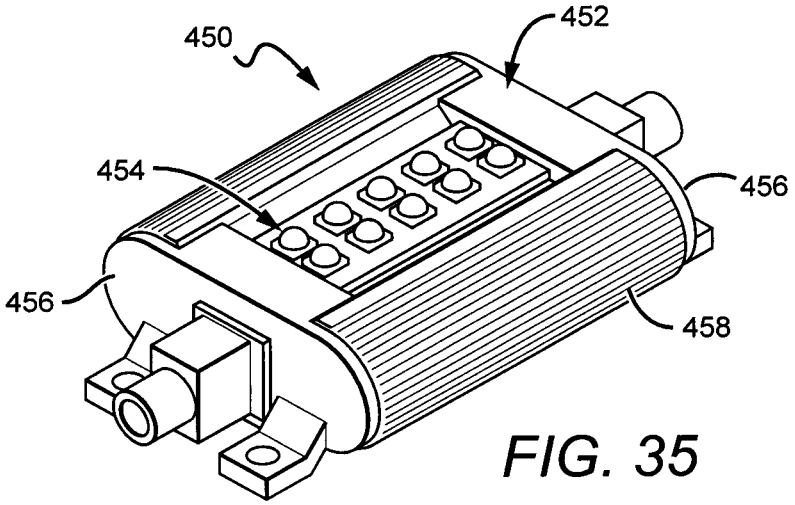
FIG. 35
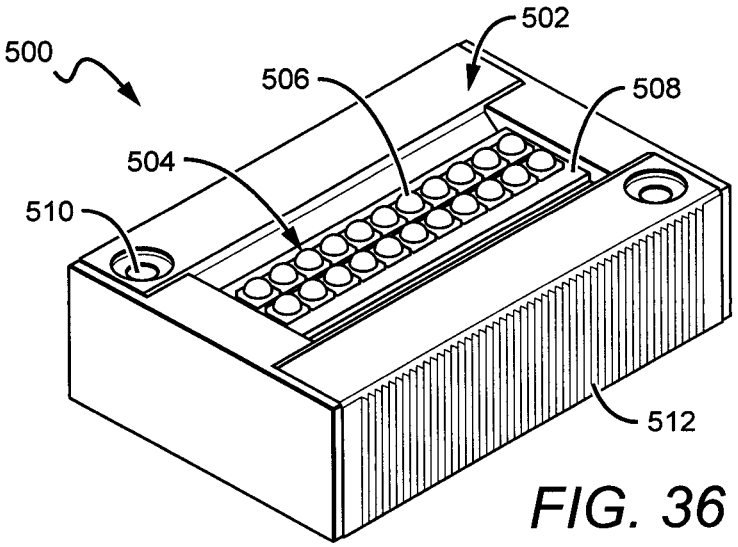
FIG. 36

FIG. 37
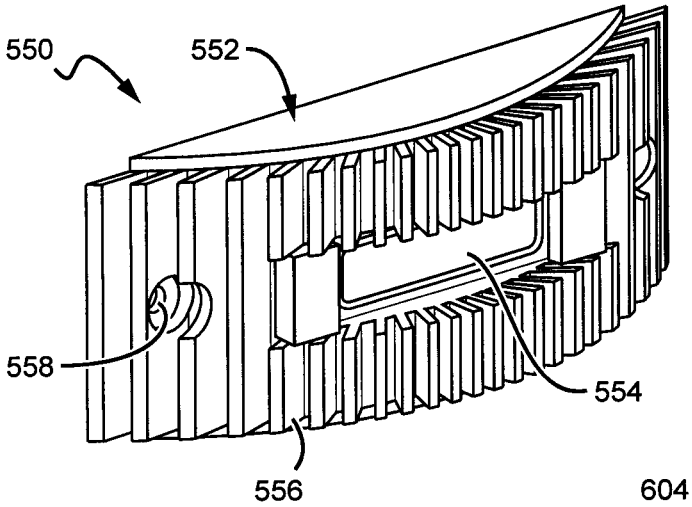
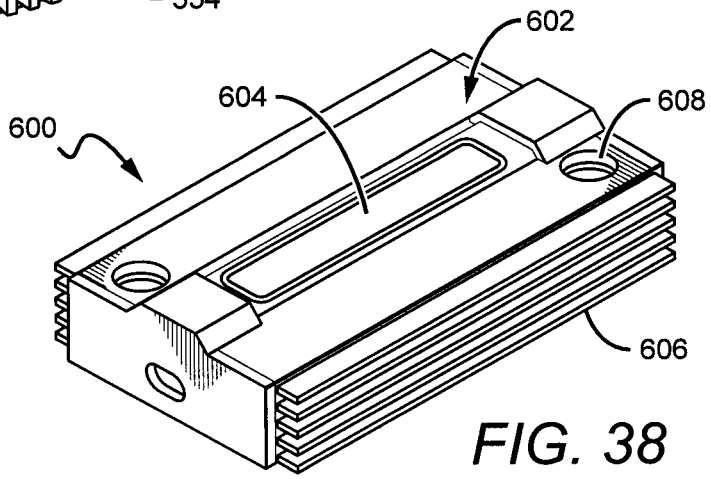
FIG. 38
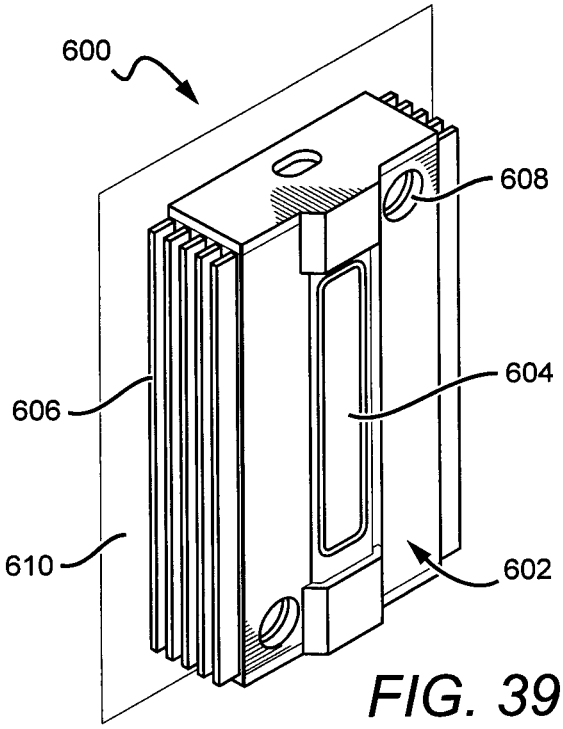
FIG. 39

FIG. 40
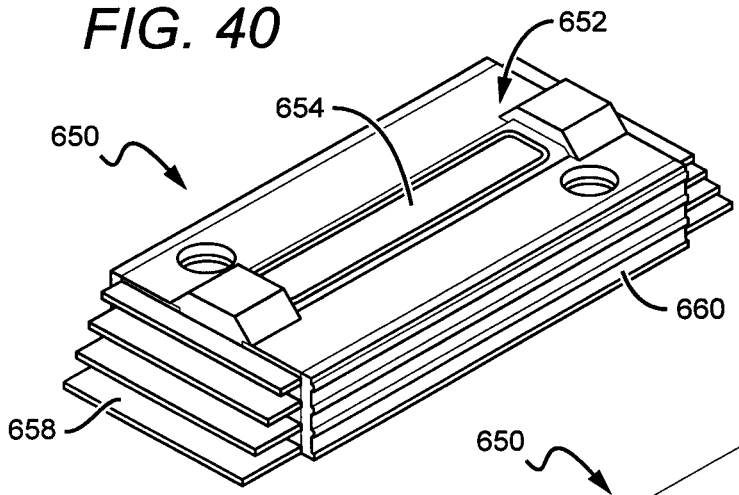
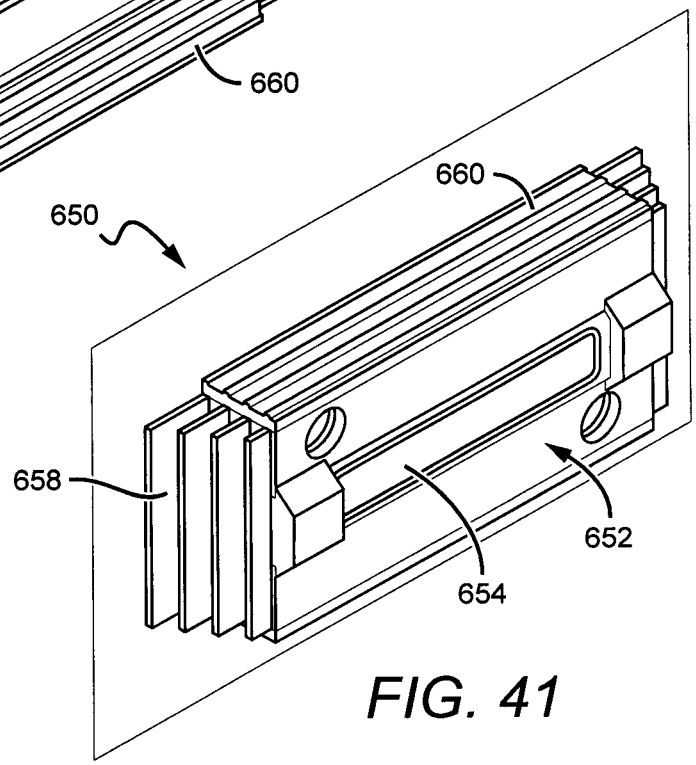
FIG. 41
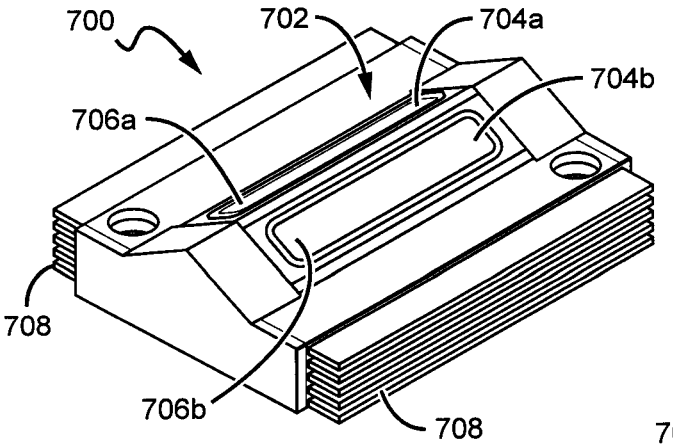
FIG. 42
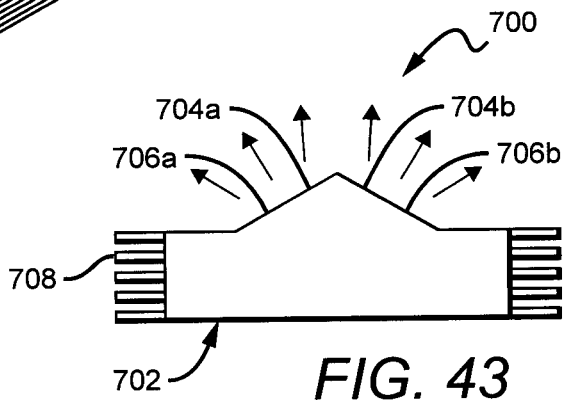
FIG. 43

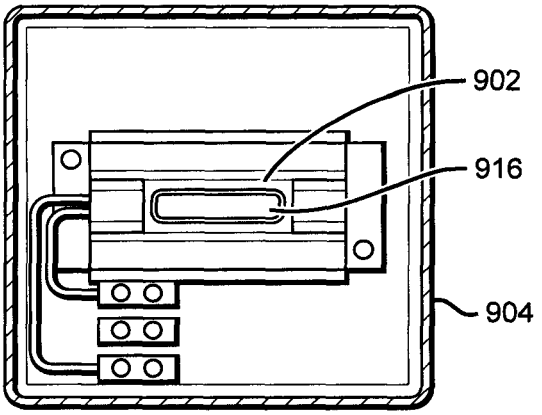
FIG. 55
FIG. 56
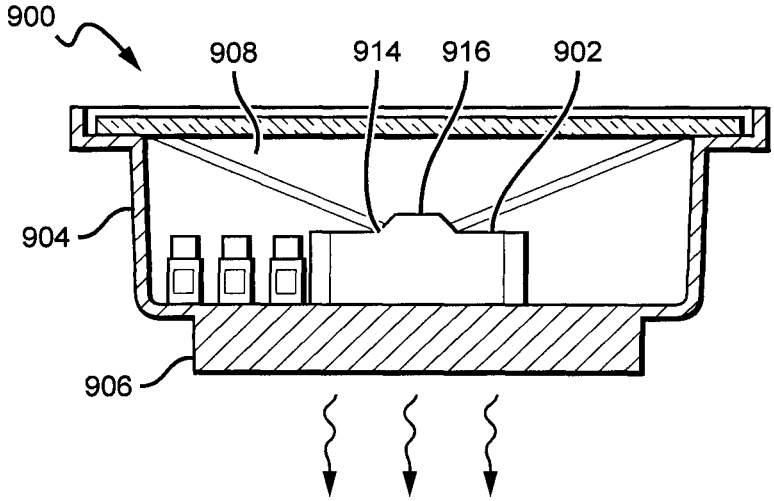
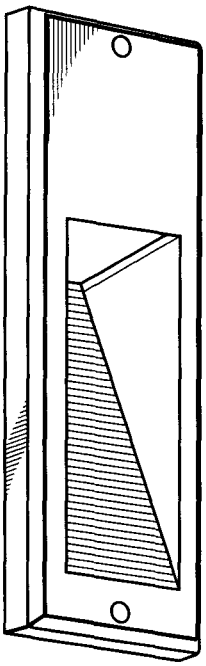
FIG. 58
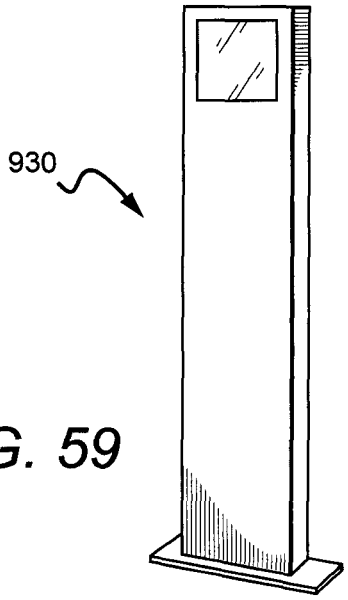
FIG. 59

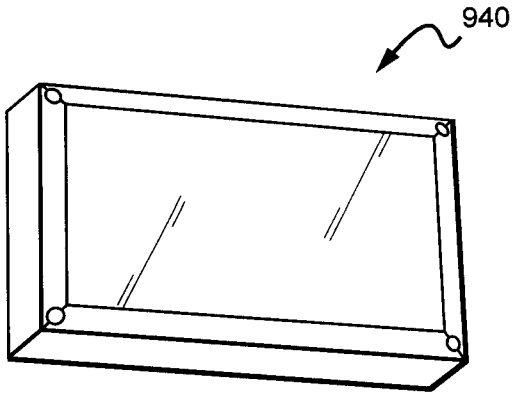
FIG. 60
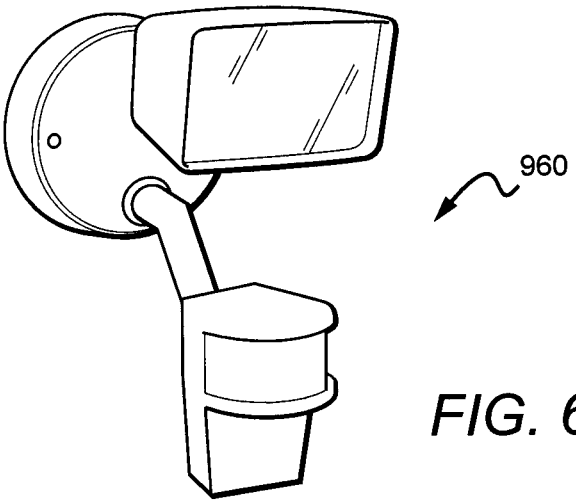
FIG. 61
FIG. 62
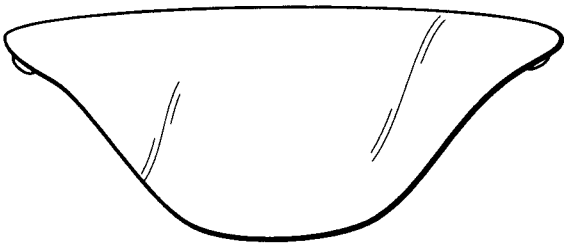

LED MINI-LINEAR LIGHT ENGINE

BACKGROUND OF THE INVENTION

Field of the Invention

This invention relates to solid state lamps and light engines and in particular to relatively small size light engines with integral power supplies that can operate at high voltage and can emit relatively high luminous flux.

Description of the Related Art

Light emitting diodes (LED or LEDs) are solid state devices that convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package, a single LED chip can be mounted on a reflective cup by means of a solder bond or conductive epoxy. One or more wire bonds connect the ohmic contacts of the LED chip to leads, which may be attached to or integral with the reflective cup. The reflective cup may be filled with an encapsulant material which may contain a wavelength conversion material such as a phosphor. Light emitted by the LED at a first wavelength may be absorbed by the phosphor, which may responsively emit light at a second wavelength. The entire assembly is then encapsulated in a clear protective resin, which may be molded in the shape of a lens to collimate the light emitted from the LED chip. While the reflective cup may direct light in an upward direction, optical losses may occur when the light is reflected (i.e. some light may be absorbed by the reflector cup due to the less than 100% reflectivity of practical reflector surfaces). In addition, heat retention may be an issue for a package, since it may be difficult to extract heat through the leads.

A conventional LED package may be more suited for high power operations which may generate more heat. In the LED package, one or more LED chips are mounted onto a carrier such as a printed circuit board (PCB) carrier, substrate or submount. A metal reflector mounted on the submount surrounds the LED chip(s) and reflects light emitted by the LED chips away from the package. The reflector also provides mechanical protection to the LED chips. One or more wirebond connections are made between ohmic contacts on the LED chips and electrical traces on the submount. The mounted LED chips are then covered with an encapsulant, which may provide environmental and mechanical protection to the chips while also acting as a lens. The metal reflector is typically attached to the carrier by means of a solder or epoxy bond.

LED chips, such as those found in the LED package can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices".

Lamps have been developed utilizing solid state light sources, such as LEDs, with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." LED based bulbs have also been developed that utilize large numbers of low brightness LEDs (e.g. 5 mm LEDs) mounted to a three-dimensional surface to achieve wide-angle illumination. LED replacement bulbs have also been developed to replace conventional Edison bulbs, with some of these replacement bulbs described in U.S. patent application Ser. No. 13/018,291, to Tong et al., entitled "LED Lamp or Bulb With Remote Phosphor and Diffuser Configuration With Enhanced Scattering Particles."

Another class of conventional lamps are referred to as J-type Halogen lamps that comprise a filament based tube type incandescent bulb with the filament connected between two terminals, each of which is located at a respective end of the tube. J-type lamps provide high output and can be arranged in a low profile fixture compared to those fixtures using other bulbs such as 119 or PAR bulbs. This slimmer profile can be popular for certain applications such as wall sconces, flood lights and under counter light sources. Typical J-type fixtures operate at very high temperature, which can limit some of their applications.

Some LED modules have been developed to replace conventional J-type lamp sources, but most are arranged with a driver or power supply that is separate from the LED module. This can increase complexity in cost and installation, and can result in an overall light source that requires more space. Other LED modules are arranged without sufficient thermal management, with some not having adequate thermal contact with its lamp or luminaire housing to dissipate heat to the ambient. This can result in heat from the LEDs being trapped and building up in the LED module during operation. This heat build-up can reduce brightness of the LED module, and can reduce the reliability and operation life span of the module.

SUMMARY OF THE INVENTION

Embodiments of the present invention are generally related to state light engines utilizing solid state light sources, and having integral power supplies or drivers. Some embodiments of the light engines are arranged to provide a bright, non-symmetrical emission pattern that provides a relatively high luminous flux from a relatively small area. The light engines according to the present invention are particularly arranged to manage the temperature of the light engine light sources to provide improved emission and reliability.

One embodiment of a solid state light engine, according to the present invention comprises an elongated solid state light source mounted on a light engine housing. The housing at least partially comprises a thermally conductive material and the light source is in thermal contact with the housing. A power supply can be arranged within the housing to convert a light engine input signal to a light source drive signal. The housing is arranged to provide a heat conducting path the light source around the power supply.

One embodiment of a solid state light fixture according to the present invention comprises a fixture housing with a solid state light engine mounted to the fixture housing with thermal contact between the two. The light engine can comprise an elongated solid state light source mounted on a thermally conductive light engine housing, with the light source in thermal contact with the light engine housing. A power supply can be arranged within the light engine housing with the housing surrounding the power supply and providing a heat conducting path around the power supply to the fixture housing.

Another embodiment of a light engine according to the present invention comprises a solid state light source mounted on a thermally conductive light engine housing, with the light source in thermal contact with the housing and the housing mounted to a heat sink. A power supply is arranged internal to the housing with the power supply between the light source and the heat sink, with the housing providing a heat conducting path around the power supply.

One embodiment of a bulb replacement solid state light engine comprises a solid state light source mounted on a thermally conductive light engine housing, with the light source in thermal contact with the housing. The housing is mounted to a heat sink and the light source has a length to width ratio greater than 3 to 1. A power supply can be arranged internal to the housing with the housing providing a heat conducting path around the power supply.

These and other aspects and advantages of the invention will become apparent from the following detailed description and the accompanying drawings which illustrate by way of example the features of the invention.

BRIEF DESCRIPTION OF THE DRAWINGS

FIG. 3 a top view of the light engine shown in FIG. 1;

FIG. 4 is an end view of the light engine shown in FIG. 1;

FIG. 5 is a side view of the light engine shown in FIG. 1;

FIG. 6 is end sectional view of the light engine shown in FIG. 1;

FIG. 7 is a bottom view of the light engine shown in FIG. 1;

FIG. 8 is side sectional view of the light engine shown in FIG. 1;

FIG. 9 is an exploded view of the light engine shown in FIG. 1;

FIG. 10 is a top view of one embodiment of a light source that can be used in light engines according to the present invention;

FIG. 11 is a top perspective view of another embodiment of a light engine according to the present invention;

FIG. 12 is a bottom perspective view of the light engine shown in FIG. 11;

FIG. 17 is a bottom view of the light engine shown in FIG. 11;

FIG. 18 is a top view of an embodiment of a light source that can be used in light engines according to the present FIG. 19 is a top perspective view of one embodiment of a light engine according to the present invention;

FIG. 20 is a bottom perspective view of the light engine shown in FIG. 19;

FIG. 21 is a top view of the light engine shown in FIG. 19;

FIG. 22 is an end view of the light engine shown in FIG. 19;

FIG. 23 is a side view of the light engine shown in FIG. 19;

FIG. 27 is a bottom perspective view of the light engine shown in FIG. 26;

FIG. 28 a top view of the light engine shown in FIG. 26;

FIG. 29 is an end view of the light engine shown in FIG. 26;

FIG. 30 is a side view of the light engine shown in FIG. 26;

FIG. 31 is an end sectional view of the light engine shown in FIG. 26;

FIG. 32 is a bottom view of the light engine shown in FIG. 26;

FIG. 33 is an end sectional view of one embodiment of a light engine according to the present invention showing the flow of heat from a light source;

FIG. 34 is a top perspective view of another embodiment of a light engine according to the present invention;

FIG. 35 is a top perspective view of still another embodiment of a light engine according to the present invention;

FIG. 36 is a top perspective view of still another embodiment of a light engine according to the present invention;

FIG. 37 is a top perspective view of still another embodiment of a light engine according to the present invention;

FIG. 38 is a top perspective view of still another embodiment of a light engine according to the present invention;

FIG. 39 is a perspective view of the light engine in FIG. 38 mounted to a surface;

FIG. 40 is a top perspective view of still another embodiment of a light engine according to the present invention;

FIG. 41 is a perspective view of the light engine in FIG. 38 mounted to a surface;

FIG. 42 is a top perspective view of still another embodiment of a light engine according to the present invention;

FIG. 43 is an end view of the light engine in FIG. 42;

FIG. 55 is a top sectional view of the light fixture shown in FIG. 51;

FIG. 56 is a side sectional view of the light fixture shown in FIG. 51;

FIG. 58 is a perspective view of another light fixture using a light engine according to the present invention;

FIG. 59 is a perspective view of another light fixture using a light engine according to the present invention;

FIG. 60 is a perspective view of another light fixture using a light engine according to the present invention;

FIG. 61 is a perspective view of still another light fixture using a light engine according to the present invention; and FIG. 62 is a perspective view of another light fixture using a light engine according to the present invention.

DESCRIPTION OF EMBODIMENTS OF THE INVENTION

Figure 1:
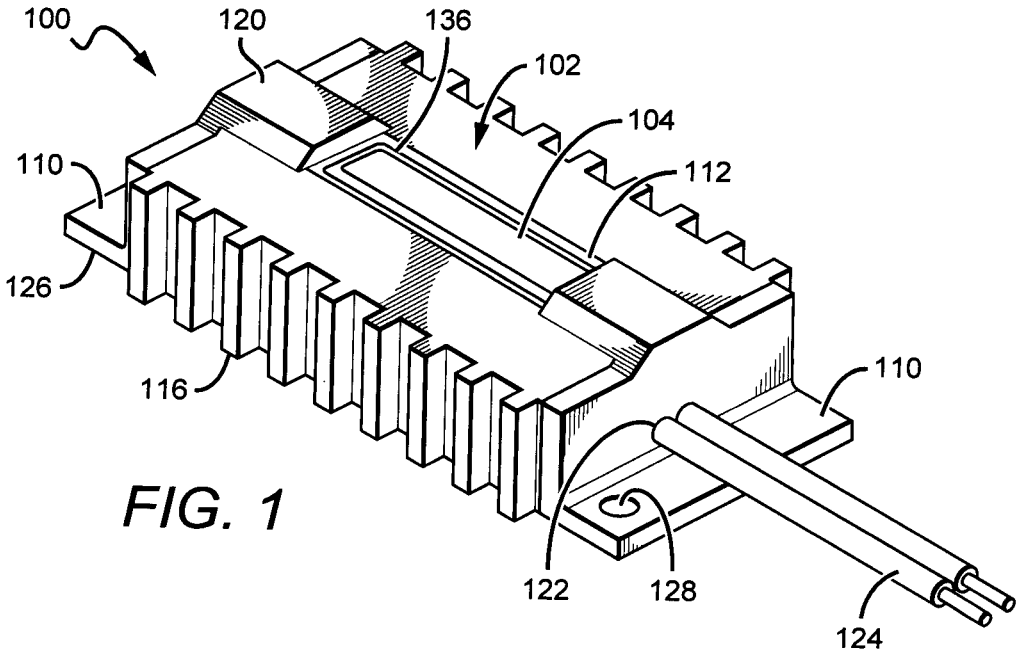
FIG. 1 is a top perspective view of one embodiment of a light engine according to the present invention.
Figure 2:
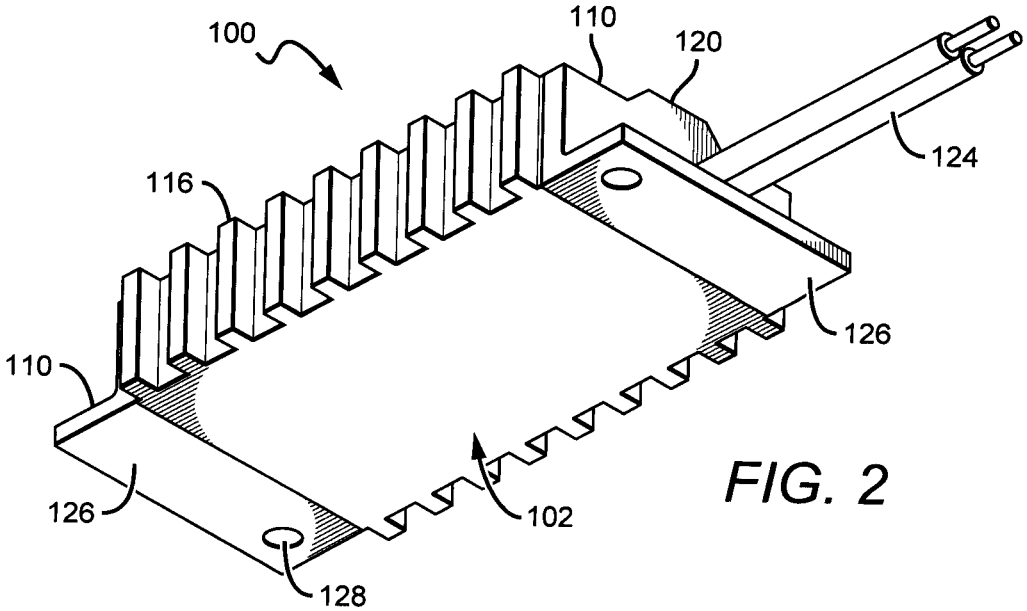
FIG. 2 is a bottom perspective view light engine shown in FIG. 1.
Figure 13:
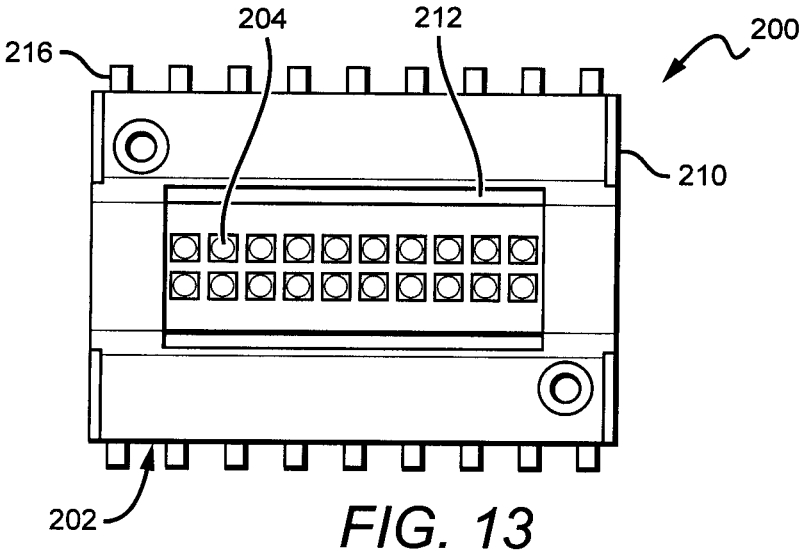
FIG. 13 a top view of the light engine shown in FIG. 11.
Figure 14:
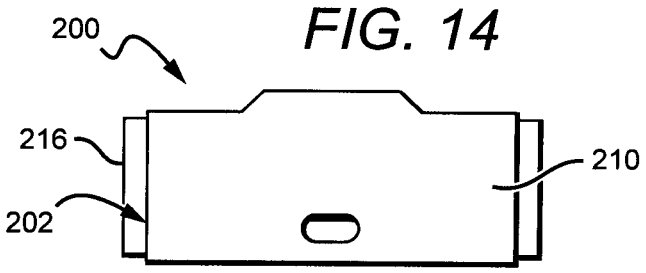
FIG. 14 is an end view of the light engine shown in FIG. 11.
Figure 15:
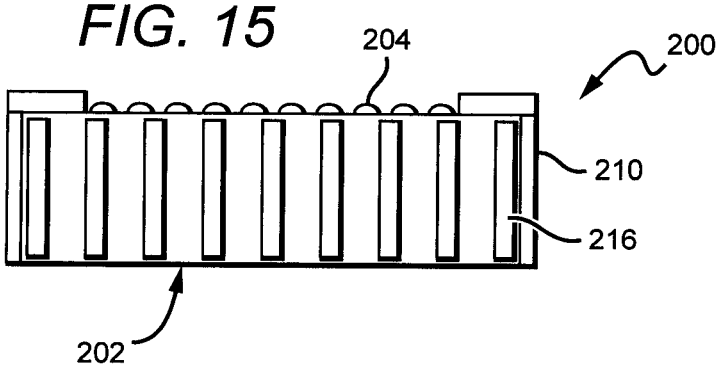
FIG. 15 is a side view of the light engine shown in FIG. 11.
Figure 16:
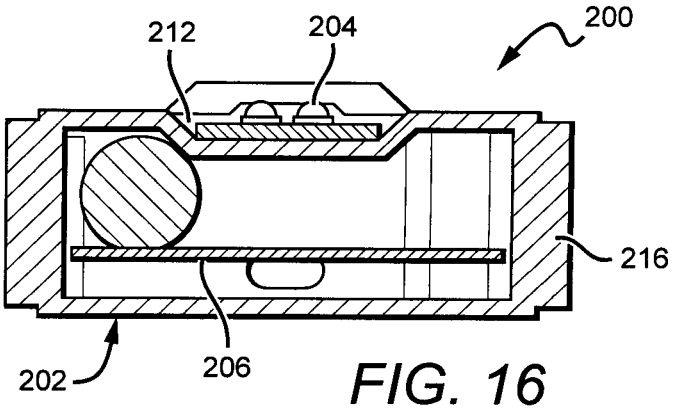
FIG. 16 is an end sectional view of the light engine shown in FIG. 11.
Figure 24:
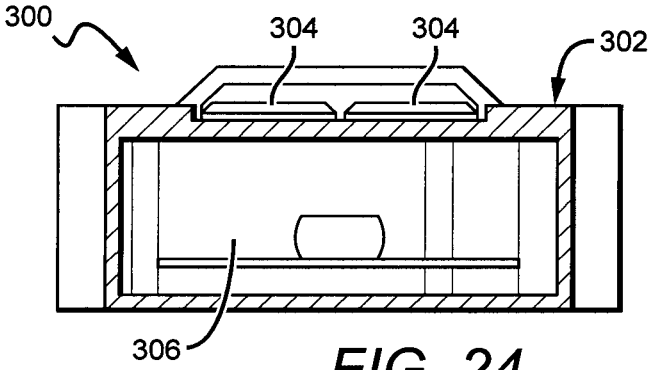
FIG. 24 is an end sectional view of the light engine shown in FIG. 19.
Figure 25:
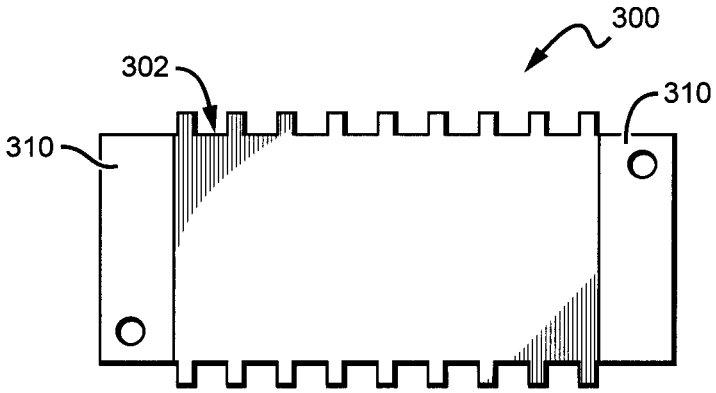
FIG. 25 is a bottom view of the light engine shown in FIG. 1.
Figure 26:
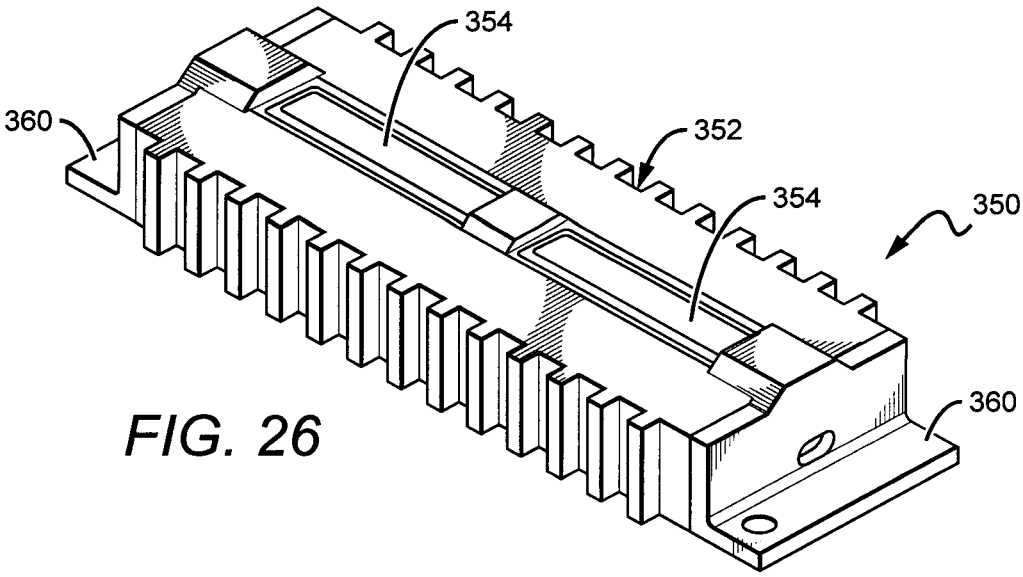
FIG. 26 is a top perspective view of one embodiment of a light engine according to the present invention.

The present invention is directed to solid state light engines that are arranged to provide a bright, non-symmetrical emission pattern that provides a relatively high luminous flux from a relatively small area. The present invention can be used in many different types and sizes of light sources, with some embodiments providing a light quantity, quality and distribution similar in size to conventional J-type Halogen light sources. The embodiments can provide these emission patterns while generating significantly less heat, significantly higher efficiency and greater life space. In some embodiments, the light can perform similarly to a halogen J-type Lamp 80 mm light tube, while generating similar or greater luminous flux. The light engines according to the present invention can also provide the capability to be used in low profile light fixtures.

The light engine embodiments according to the present invention are particularly arranged with light sources comprising LED chips or LED packages, and are arranged to keep the junction temperature of these emitters relatively low. This can improve the emission pattern and reliability of the emitters. The light engines can comprise thermal interfaces and radiation paths between the emitters and the ambient to decrease thermal resistance for heat from the emitters. The heat can radiate to the ambient directly from the light engine housing, or can conduct into the surface where the light engine is mounted, and then to the ambient. This arrangement provides for improved and efficient thermal management for the light engines according to the present invention.

Embodiments of the light engines according to the present invention can also comprise integral power supplies. That is, a separate power supply is not needed for use of the light engines and the light engines can be directly connected to line voltage using conventional means, such as a connector, tag wire or a terminal block. By not having a separate power supply, the light engines according to the present invention are much more compact and simpler to use. The light engines can be arranged with insulating elements to thermally isolate the particular power supply from the emitters and light engine housing. This can minimize the amount of heat from the power supply that radiates to the emitters and housing, thereby minimizing the impact of temperature cross-talk and build up between the power supply and emitters. This further improves reliability of the light engines. These insulation elements can also provide electrical insulation between the power supply and emitters to further improve reliability. It is understood that in embodiments where the power supply is small enough, insulation elements may not be necessary.

In some embodiments, the power supplies can be in the light housings with the light engine housings providing a heat conductive path to conduct heat from the light source, around the power supply, to the ambient. As described in more detail below, the light engine embodiments can comprise a power supply sandwiched between the light source and the heat sink (e.g. fixture housing), with the housing providing a heat conductive path to conduct heat from the light source to the heat sink.

The light sources used in the light engines according to the present invention are described herein as being non-symmetrical. Many light sources, such as some LED packages, can have emitters that are arranged around a point, such as in circular type light sources that can have emitters arranged around a central point. The light sources in some of the embodiments according to the present invention have rectangular type light sources that can be relatively long and thin. Some of these embodiments can have emitters that are arranged in irregular pattern, instead of a symmetrical pattern.

The light engines according to the present invention can have many different sizes, with some having a length of approximately 1-3 inches, and others having lengths of up to 1 to 2 feet or more. Different embodiments can have one or more light sources arranged side-by-side, end-to-end, or at angles. The different light engine embodiments can have heat fins arranged in different locations on the light engine housing to assist in heat radiation, and the light engines can comprise different mounting arrangements for mounting to the desired surface.

The light engines according to the present invention can be used in many different types of light fixtures, including but not limited to: architectural/decorative light fixtures; portable light fixtures; bulk head, ceiling or wall mount fixtures; flood light; etc. Some embodiments of light engines according to the present invention can be arranged to meet the Zhaga Module Mechanical Specification (www.zhaga-standard.org/specification/book-1.html), which is incorporated herein by reference.

The present invention is described herein with reference to certain embodiments, but it is understood that the invention can be embodied in many different forms and should not be construed as limited to the embodiments set forth herein. In particular, the present invention is described below in regards to light engines having housings and light sources in different configurations, but it is understood that the present invention can be used for many other light engines with other configurations. The light engines can have many different shapes and sizes beyond those described below. For example, some embodiments of light engines are described as sized for J-type light fixtures, but it is understood that that light engines can have many different sizes and form factors.

It is understood that when an element is referred to as being "on", "between" or "sandwiched between" another element, it can be directly on, between or sandwiched between the other elements, or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures, and intervening elements can be between elements described with these relative terms.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "light source" can be used to indicate a single light emitter or more than one light emitters functioning as a single source. For example, the term may be used to describe the light source used in a J-type lamp or luminaire, and it is understood that such a source can comprise a plurality of solid state emitters such as LED chips or LED packages. Thus, the term "source" should be construed as indicating either a single-element or a multi-element configuration.

FIGS. 1-9 show one embodiment of an linear light engine embodiment of a light engine 100 according to the present invention generally comprising a housing 102 and a solid state light source 104 mounted to and in thermal contact with the housing 102. The housing 102 can be made of many different materials arranged in many different ways, with the housing 102 shown being sized and shaped to hold an internal power supply or driver 106, while at the same time providing an efficient heat conductive path to dissipate heat from the light source 104. The housing 102 can be made of many different components and materials, with housing shown comprising a hollow box portion 108 with open ends that are covered by end caps 110. The housing 102 can fully or partially comprise thermally conductive material for conducting heat from the light source, with some of these conductive materials comprising a metal, ceramic or zinc material. In some embodiments, the housing can comprise a metal such as aluminum (Al) with housing formed using known molding, die cast or extrusion processes. In other embodiments, the housing 102 can comprise a plurality of pieces bonded together.

The housing 102 can comprise a lighting channel 112 sized on its top surface to hold light source 104. The light source 104 can be mounted in the slot using many different methods and materials including bonding with a conductive bonding material, or screwing in place. The channel 112 can have opposing slots 114 at opposing ends for wires to pass from internal to the housing 102 to the light source 104, with some embodiments having wires passing from the power supply 106 to the light source 104.

The housing further comprises heat fins 116 that can be arranged in many different locations and in many different orientations. In the embodiment shown, the heat fins 116 are on the side surfaces of the housing 102 and are arranged in vertical orientation. The heat fins 116 increase the surface area of the housing 102 to help further help dissipate heat from the light source 104 to the surrounding ambient. The heat fins can be formed in many different ways such as through sawing or grinding of the side surfaces following extrusion, or during the mold formation process.

Different embodiments of the end caps 110 can be made of many different materials and can have many different features, with the end caps 110 arranged to cover the openings to the housing 102. The end caps 110 can be made of conventional materials such as plastics, and can be formed using convention processes such as injection molding. The end caps 110 can be mounted in place in different ways, with the embodiment shown being bonded in place. Other embodiments can be arranged to snap in place or screwed in place. The end caps can comprise internal tabs 118 arranged to align with the inside surface of the housing opening to help align the end cap with the housing opening. A bonding material can be included on the tabs 118 and/or the inside surface of the end cap to hold it in place.

Each of the end caps 110 can have a protective finger 120 that extends over the channel 112. In some embodiments, the fingers can help hold the light source 104 in place within the channel 112. In other embodiments, the finger 120 can provide protection for the wire connection for the wire passing through the slot 114 and being connected at the light source 104. The fingers 120 can have many different shapes and sizes with the embodiment shown having rectangular shape with tapered side surfaces. It is understood that other embodiments can be provided without an end cap finger.

Each of the end caps 110 also comprises a wire opening 122 for allowing conductors or input wires 122 to pass from outside the housing 102, through the end plates to the inside of the housing 102. The input wires 122 can be conventional wires carrying conventional line electrical signals such as 120 VAC or 230 VAC. These are only two of the many different signals that can be accepted by light engines according to the present invention, with the signals being converted to the desired drive signal by the power supply 106.

The end cap 110 can also comprise a mounting surface 124 that is generally orthogonal to the end cap surface covering the end of the housing 102. The mounting surface 124 can be arranged for mounting the light engine 104 to the desired surface using conventional mounting methods such as bonding materials, tape, screw, snaps, Velcro®, etc. In the embodiment shown, the end cap has a mounting hole 128 through which a screw can pass to mount the light engine in place. It is understood that end caps can be provided without the mounting surface 126 as further described below, and that other light engine embodiments can be provided without end caps.

In light engine embodiments according to the present invention, the power supply 106 does not comprise a separate component, but is instead mounted internal and integral to the housing 102. This arrangement results in a light engine that is much easier to install and operate, and a light engine that takes up less space. As further described below, a typical power supply 106 can comprise electronic components arranged to convert the electrical signal from the input wires 124 to the desired signal to drive the light source 104. The drive signal from the power supply 106 can be conducted to the light source 104 along wires passing through slots 114, with the wires then connected to the light source. The power supply 106 can be mounted in the housing 102 in many different ways, with some housing embodiments having an internal slot, with the printed circuit board (PCB) 130 from the power supply 106 sliding on and being held in the housing on the slot. In still other embodiments, the power supply 106 can be held in place in the housing conventional bonding materials or mechanisms.

The light engine 100 can also comprise many different features to allow for long term reliable operation. In the embodiment shown, the light engine 100 can comprise insulation sleeve 132 surrounding the power supply 106 and sized to fit within the housing 102. This insulation sleeve 132 comprises a material to provide electrical and/or thermal isolation between the power supply 106 and the surrounding housing 102 and light source 104. This protects the light engine 100 from electrical shorting between the power supply 106 and housing 104, and ultimately to the light source 104. The insulation element can also prevent or reduce the transfer of heat between the power supply 106, housing 102, and light source 104.

The insulation sleeve can be made of many different electrically insulating materials such as rubber or plastic. The sleeve 132 can be sized to hold power supply 106 and to then slide into the housing 102 through one the side opening. The insulation sleeve 132 can also comprise insulation sleeve holes 134 for input wires to pass through to accept the input signal from outside the power supply 106, and for wires from the power supply to the light source to pass for driving the light source 104. The insulation sleeve can be arranged in many different ways in other embodiments, and in some embodiments the sleeve can be formed as part of the end cap. Still other embodiments can be provided without an insulation sleeve.

The light engines according to the present invention can comprise many different light sources arranged in many different ways. The light source 104 shown above in FIGS. 1, 3 and 9 comprises an elongated substrate or submount 136 holding a plurality of interconnected lighting elements such as LEDs, LED chips, LED packages, or a combination thereof. The ends of the submount 136 can have respective contact pads 138 for connecting to wires passing through the slots 114 and carrying the desired drive signal. The LEDs and/or LEDs chips can be interconnected in series or in different series parallel combinations. The preferred light sources operate of a relatively high voltage, low current drive signal. One example of a suitable drive signal comprises a 200V to 230V DC signal.

FIG. 10 shows one embodiment of a light source 140 in more detail that comprises a plurality of LED chips 142 mounted to a submount 144 in a "chip on board" arrangement. The light source can be arranged in many different ways and can have many different features including those commercially available from Cree, Inc., under its CXA family of lighting components. These components provided with a circular emission area having a plurality of LED are generally provided in a circular emission area, but it is understood that these devices can also be provided with an elongated emission area such that the devices are compatible with the light engines according to the present invention. The features of the CXA lighting components are described in U.S. patent application Ser. No. 13/671,089, assigned to Cree, Inc., and incorporated herein by references. For light source 140, the LED chips 142 can be connected in series with interconnects or traces on the submount 144. The light source 140 can contain different numbers of LED chips, with the embodiment shown having approximately 70 chips 142 interconnected in series. Each chip has an approximate 3V junction voltage with the series interconnections resulting in an overall light source voltage in the range of 190 to 210V. In some embodiments, the light source can operate from a light source voltage of approximately 200 V. Different light sources can be provided that operate from different voltages by providing different numbers of LED chips, by providing LED chips with different junction voltages, and/or interconnecting the LED chips in different ways. It is understood that different types and sizes of LED chips can be used for different power and efficacy requirements. It is also understood that the light sources can have different trace clearances, with some having a trace clearance of approximately is 2.0 mm after singulation.

The light engines according to the present invention can be arranged to operate with many different characteristics. Some embodiments can provide a light source emitting light with 500 or more lumens, while in other embodiments it can emit light with 750 or more lumens. In still other embodiments, the light source can emit light with 1000 lumens or more, with some operating at 1000 to 1200 lumens. Some embodiments of the light source can also emit light with a color rendering index (CRI) of 60 or more, while other embodiments can emit light with a CRI of 70 or more. Still other embodiments can emit light with CRI of 80 or more. Some embodiments of the light source can emit light with a correlated color temperature (CCT) in the range of 2500-10,000K, while other embodiments can emit light with a CCT in the range of 2500-3000K. Some embodiments can emit light with a CCT of approximately 2700 or 3000K. The light sources can have an efficacy 80 lumens per watt (LPW) or greater at different temperatures, 90 LPW or greater at different temperatures, or 100 LPW at different temperatures. These different efficacies can be achieved in different embodiments at a temperature of approximately 100 C.

The light source can also have many different lengths and widths, with some embodiments having an emission area with a length in the range of 20 to 200 mm, and a width in the range of 2 to 20 mm. Light source 140 shown in FIG. 10 can have dimensions of approximately 45 mm length by 10 mm width, with an emission area of approximately 35.5 mm by 5 mm. The different embodiments can have light sources with emission areas having relatively high length to width ratios, with some having a 3 to 1 ratio or greater and others having a 5 to 1 ratio or more. Still others can have a 6 to 1 or greater ratio. In some embodiments, the ratio can be approximately 7 to 1.

The shapes and sizes for the light sources and their emission areas allow for the light engine to take many different sizes, with some embodiments being less than the size of a match box. As described herein, the light engines can be provided with an integral driver and easy to use terminal block or wire tags for direct connect to line voltage such as 120 VAC and 230 VAC versions. For a light source operating from power supply DC voltage of approximately 200V, the light source can operate from 10 W or less, and can also be dimmable. Different embodiments can operate with a PF greater than 0.7 for ES residence or 0.9 for ES commercial. The light engines can have different operations lifespans, with some having a lifespan of 50,000 hours or more at room temperature.

FIGS. 11-17 show another embodiment of a light engine 200 according to the present invention having many features similar to the light engine 100 described above and shown in FIGS. 1-9. The light engine 200 comprises a housing 202, light source 204, power supply 206 (shown in FIG. 16) and end caps 210. The housing 202 can be made of the same thermally materials as the housing described above, and can be arranged with a channel 212 for holding the light source 204 and vertical heat fins 216 to help dissipate heat from the light source. Like above, the housing 202 can have heat fins arranged in many different ways with many different orientations. This housing 202 can be hollow to hold the power supply 206 and in some embodiments can have an insulation sleeve (not shown) as described above.

In this embodiment, the end caps 210 do not have a mounting surface as shown in the end cap 110 shown above in FIG. 1-9. The end caps 210 cover the housing opening, with each comprising one or more holes for input wires to pass to the internal power supply. The light engine can be mounted in place using many different methods and devices, with one embodiment using screws that pass through light engine holes 220 on the back of the housing 202. The housing can also be mounted in place using an adhesive, tape, Velcro®, etc.

In some embodiments of the light engine 200, the light source 204 can be arranged similar to the light source 104 described above. However, it is understood that the light source can be arranged in many different ways. FIG. 18 shows another embodiment of light source 240 that can be used in light engines according to the present invention. In the embodiment shown, the light source 240 does not comprise a plurality of LED chips mounted on a submount, but instead comprises a plurality of LED packages 242 mounted to a substrate or printed circuit board (PCB) 244 having the necessary interconnects to connect the LED packages in the desired series or parallel interconnect pattern. Many different commercially available LED packages can be used, including but not limited to, LED packages in the Xlamp XP or Xlamp XP family of LED packages commercially available from Cree, Inc.

In some embodiments the light source 240 can comprise a standard PCB or metal core PCB to help dissipate heat from the LED packages. The LED chips can be interconnected in different ways and in the embodiment shown are connected in two sets of nine serially interconnected LED packages, which can allow the light source to operate. The LED packages can be arranged so that the light source 240 operates from at approximately 10 W or less, and the LED package interconnects can be provided with a trace clearance of approximately 1.6 mm. The light source 240 can also comprise contact pads 246 at opposing ends for applying an electrical signal from the power supply to the LED packages 242. This is only one of the many alternative LED package arrangements that can be utilized according to the present invention.

It is understood that different embodiments of the light engines according to the present invention can be arranged with more than one light source, with the light sources arranged in different ways on the light engine housing. In some embodiments, the light sources can be in proximity to one another in different arrangements. FIGS. 19-25 show another embodiment of light engine 300 according to the present invention having a housing 302 similar to these described above, but having two light sources 304 arranged side by side on the housing 302. The housing can have a two side-by-side channels for holding the light sources 304. The light engine 300 can also comprise a power supply 306 (shown in FIG. 24) within the housing 302, and end caps 310 over the open ends of the housing 302. The light sources 304 can be similar to those described above, and by providing two light sources the light engine 300 can produce and increased luminous flus.

It is also understood that the light engines can be used in many different applications beyond J-type light fixtures and can be provided in many different sizes and lengths, with some being smaller than a matchbox as described above, and others being up to 1 or more feet long. FIGS. 26-32 show another embodiment of a light engine 350 according to the present invention that is similar to the embodiments described above. The light engine comprises a housing 352, light sources 354, and power supply 356 and end caps 360. In this embodiment, however, the light sources 354 are arranged generally end-to-end to provide a longer light engine that can utilize the same or similar light sources to those described above. The light engine 350 can comprise a single or multiple power supplies to accept the input signal and generate respective drive signal to drive the light sources 354. The light sources 354 can also be connected in series or parallel such that both can be driven by the same drive signal.

FIG. 33 shows another embodiment of one embodiment of a light engine 370 according to the present invention having a housing 372, a light source 374, and an internal power supply 376, each of which can be arranged in the same way as the same elements described in the embodiments above. In operation, the light source 374 emits light and generates heat. Heat from the light source conducts into the housing 372 where a portion can radiate to the ambient around the light engine 370 as shown by first arrows 378. A further portion of the heat can conduct through the housing 372 and to the light engine's mounting surface 380, as shown by second arrows 382. The mounting surface 380 serves as a heat sink for the light engine 370, and provides and efficient path for conducting heat away from the light source 374.

This arrangement provides for a heat conductive path around the light engine's internal power supply 376, to minimize heat from the light source 374 that conducts into the power supply 376. The power supply can also be provided with a insulation sleeve (not shown) to further reduce heat transfer. This arrangement allows for the light engine to have an internal power supply (as opposed to separate power supply unit), while still allowing for the emitters on the light source 374 to operate at the desired junction temperature. This arrangement can also minimize overheating by the power supply 376.

This arrangement also results in a unique stacking or sandwich structure for important features of the light engines according to the present invention. The power supply 376 is arranged sandwiched between the heat generating light source 374 and the mounting surface 380 (i.e. heat sink). This typically results in overheating issues, but because of the thermal path provided by the housing 372 that runs around the power supply 376, these thermal issues are minimized or eliminated.

The above are only some of the different embodiments of the present invention, with other embodiments having different shapes and features arranged in different ways. FIG. 34 shows another of a light engine 400 according to the present invention having a different shape and different features compared to those described above. Like the embodiments above, the light engine comprises a housing 402 that holds a power supply (not shown), a light source 404, and end caps 406. The housing 402 can be made of different materials having different shapes, with the side surfaces 408 being curved and in thermal contact with the light source 404. The side surfaces 408 can be fabricated in many different ways, with one embodiment of the side surfaces comprising sheet metal that is stamped in its curved shape. In other embodiments, the side surface can be extruded. Other parts can be included that are mounted together to form the housing, with some or all of these parts comprising thermally conductive materials.

The end caps 406 can comprise different materials, with the embodiment shown comprising a plastic. Each end cap has mounting tabs 410 for mounting the light engine 400 in the desired location, with the tabs 410 arranged with screw holes for mounting. Each of the end caps 406 can also be arranged with a connector 412 for connecting input wires to the housing 402. The connectors can be arranged in many different ways, with some embodiments having one or more connectors on one side or end, and others having one or more connectors on opposing sides or ends. Many different connectors can be used, with some embodiments comprising commercially available connectors such as R7 connectors. The end caps can be fabricated using different methods such as injection molding. In the embodiment shown, the light source 404 comprises a plurality of LED packages 414 mounted to a submount or PCB (e.g. MCPCB) as described above.

The light source 404 is mounted between the end caps 406, with the side surfaces 408 wrapped around and mounted to the curved edges of the end caps 406. In this embodiment, heat from the LED packages can radiate into the side surfaces 408 where part of it can dissipate into the ambient around the sides of the housing. Heat can also conduct along the side surfaces 408 to the back/bottom of the light engine 400 where the heat can conduct into the surface where the engine is mounted. The area of the housing 402 along the longitudinal edges of the light source 404, can comprise angled surfaces 407 to reflect light emitted sideways from the light source to that the reflected light contributes to the desired light engine emission pattern.

FIG. 35 shows another embodiment of a light source 450 according to the present invention that is similar to the light source 400 shown in FIG. 34. It comprises a housing 452, light engine 454 and end caps 456, that can be made of the same materials and by the same methods as described above. In this embodiment, the side surfaces 458 are also curved to curved edges of the submount, but in this embodiment can comprise relatively heat fins that increase the surface area of the side surfaces 458 to enhance radiation of heat into the ambient. In the embodiment shown, the heat fins are in a horizontal orientation, but it is understood that the heat fine can also be in a vertical or angled orientation, and that heat fins can be included in other locations.

FIG. 36 shows another embodiment of a light engine 500 according to the present invention that comprises a housing 502 having a power supply (not shown) and light source 504 mounted to the housing 502. The light source 504 can comprise a plurality of LED chips 506 mounted to a PCB 508, with the PCB 508 held between portions of the housing 502 and electrically connected to the power supply.

The housing 502 can at least partially comprise a heat conductive material to radiate heat away from the light source 504. In this embodiment, the housing 502 can comprise multiple pieces bonded together or can comprise a single piece of material bent or formed into the housing 502. The housing can comprise mounting holes 510 for screws to pass for mounting the light engine 500 to the desired location. The light engine 500 can also comprise fine heat fins 508 on its side surface to assist in radiating heat from the LED package. The heat fins are in vertical orientation such that they would be orthogonal to the light engine's mounting surface, and like above the heat fins can be relatively fine. It is understood that different sized heat fins can be used that can be arranged in different orientations.

FIG. 37 shows another embodiment of a light engine 550 according to the present invention comprising a housing 552 having an internal power supply (not shown) and a light source 554, which can be any of the types described above. In this embodiment the housing has a curved top surface, and has heat fins 556 on the top surface instead of the side surface. The heat fins 556 generally cover the entire top surface of the housing 552 in a wrapped arrangement and radiating out from the top surface. The housing also comprises mounting holes 558 to accept screws for mounting the light engine 550 to the desired location. The light engine 550 is particularly applicable to being mounted on a vertical surface. In this orientation the heat fins are also arranged vertically to allow for efficient convective heat radiation.

FIGS. 38 and 39 show another embodiment of a light engine 600 according to the present invention having a housing 602 and a light source 604, both of which can be arranged the same as and comprise the same materials as the embodiments above. The housing 602 has heat fins 606 arranged on the side surface of the housing 602 and in horizontal orientation. The light engine 600 also comprises mounting holes 608 for mounting the light engine 600 in the desired location. The heat fins can be arranged such that they are parallel to or aligned with the mounting surfaces. Referring now to FIG. 39, the light engine 600 can be mounted to a mounting surface 610 in a vertical orientation, with the heat fins 606 then also being in vertical orientation and parallel to the mounting surface to allow for efficient convective heat transfer.

FIGS. 40 and 41 show another embodiment of a light engine 650 according to the present invention comprising a housing 652, a light source 654 and mounting holes 656. In this embodiment, end heat fins 658 are included on the end surfaces of the housing 652 in horizontal orientation. The side surfaces of the housing 652 can also comprise smaller side heat fins 660. The light engine 650 is particularly arranged for horizontal mounting with the end heat fins allowing for efficient convective heat transfer.

As described above, the light sources can arranged in many different ways in different embodiments, with FIGS. 42 and 43 showing another embodiment of a light engine according to the present invention having a housing 702 and two light sources 704*a*, 704*b* that are arranged to emit in different directions to provide a two direction light distribution. In this embodiment, the housing comprises first and second light source surfaces 706*a*, 706*b* light source surfaces that are angled or oblique with respect to the top surface of the housing 702. The surfaces 706*a*, 706*b* can be at many different angles to the top surface of the housing, with some embodiments being in the range of 15 to 75 degrees to the top surface. Still others can be in the range of 30 to 60 degrees, while others can be approximately 45 degrees. It is understood that some or all of the light sources can be mounted at different angles. The arrangement can allow for a broader and/or uniform light engine emission profile. The housing 702 further comprises heat fins 708 on its side surface such that the housing is particularly arranged for vertical orientation to enhance convective heat transfer.

Figure 44:
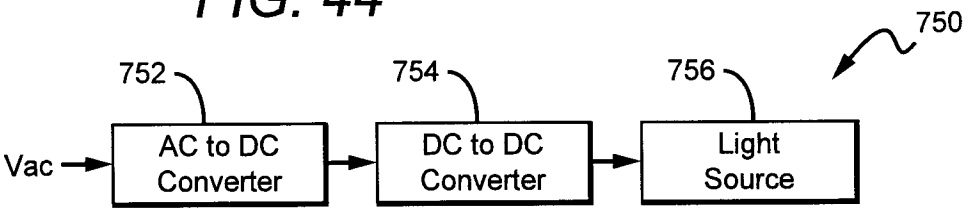
FIG. 44 is a schematic of one embodiment of power supply that can be used in light engines according to the present invention.

Many different power supplies can be used in different embodiments according to the present invention, to drive the light sources. Suitable circuits are compact enough to fit light engine housings while still providing the power delivery and control capabilities necessary to drive high-voltage LEDs, for example. FIG. 44 is a block diagram of a circuit 750 that can be used in embodiments of the present invention. An AC line voltage $V_{ac}$ comes in where it is converted to DC at the AC to DC converter 752. The resulting DC voltage is then either adjusted up or down with a DC to DC converter 754 to meet the requirements of the light source 756.

At the most basic level a driver circuit may comprise an AC to DC converter, a DC to DC converter, or both. In one embodiment, the driver circuit comprises an AC to DC converter and a DC to DC converter both of which are located inside the light engine housing. Referring to both FIGS. 44 and 45, this particular embodiment of a power supply or driver circuit 800 includes a rectifier as the AC to DC converter 802 that is configured to receive an AC line voltage. The AC to DC converter 802 may be a full-wave bridge rectifier, but it is understood that other rectifiers can be used. The output of the rectifier 802, which may be a full-wave rectified AC voltage signal, is provided to the DC to DC converter 804 which can be a switched-mode power supply, but it is understood that other converters can be used. In response to the rectified AC signal, the switched-mode power supply 804 generates a DC voltage that is supplied to the light source 806.

Figure 45:
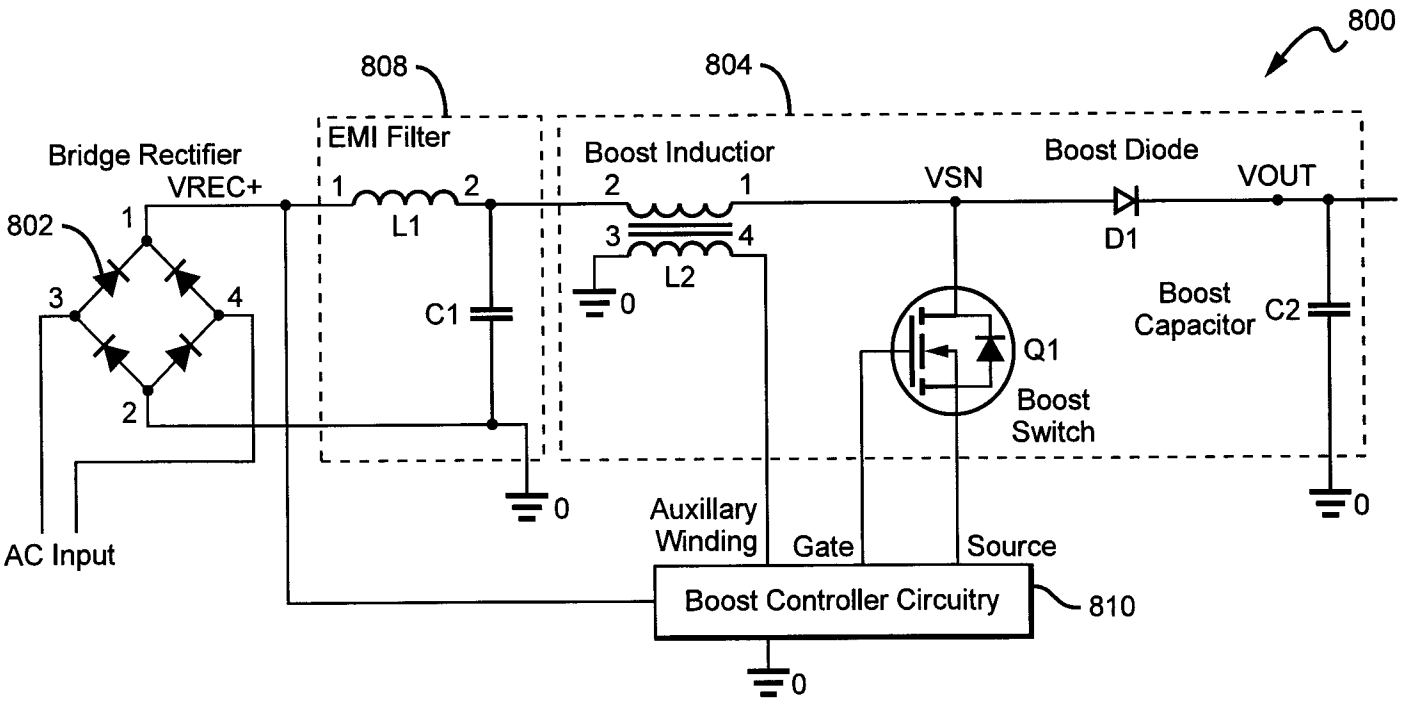
FIG. 45 is a schematic of another embodiment of a power supply that can be used in light engines according to the present invention.
Figure 46:
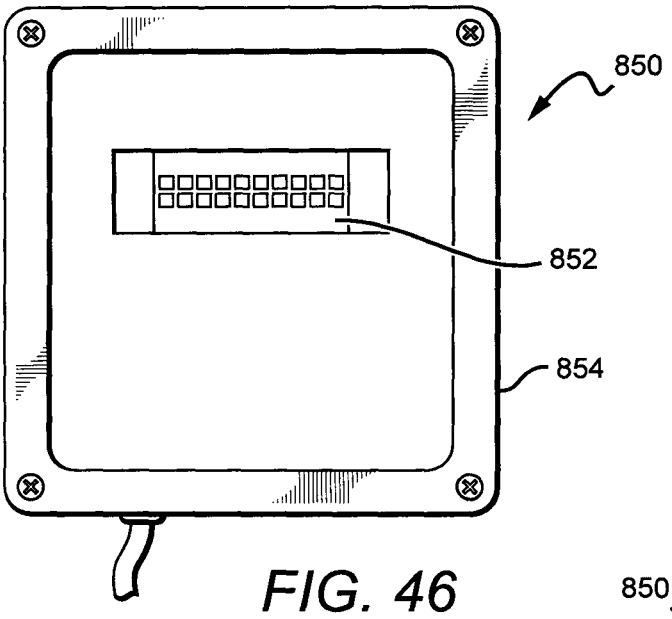
FIG. 46 is a front view of one embodiment of a light fixture utilizing a light engine according to the present invention.
Figure 47:
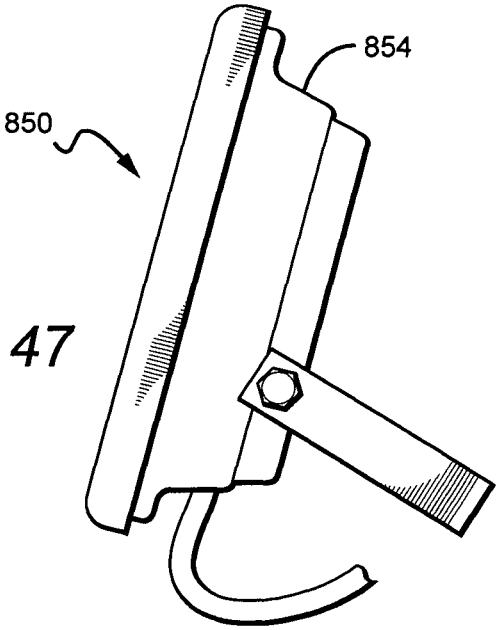
FIG. 47 is a side view of the light engine shown in FIG. 46.
Figure 48:
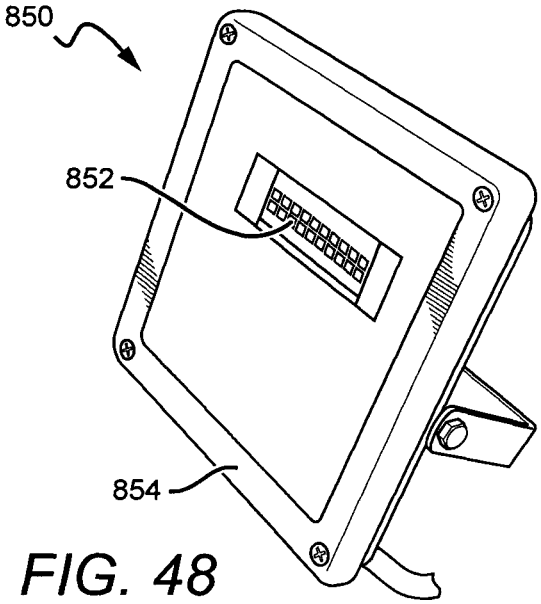
FIG. 48 is a top perspective view of the light fixture shown in FIG. 46.
Figure 49:
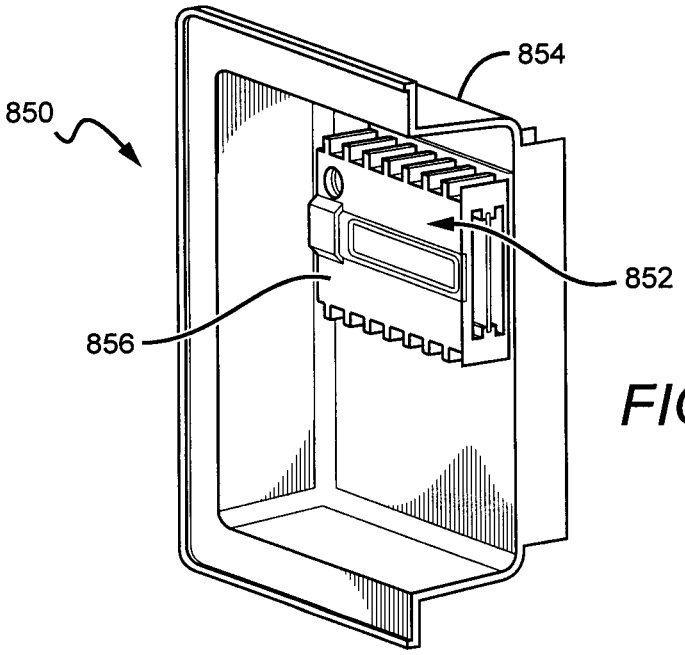
FIG. 49 is a perspective sectional view of the light fixture shown in FIG. 46.

As shown in FIG. 45, an EMI filter 808, including a series inductor L1 and a shunt capacitor C1, can be provided at an input to the switched-mode power supply 804. The EMI filter 808 can be a low pass filter that filters electromagnetic interference from the rectified line voltage.

In some embodiments, the switched-mode power supply 804 can be a boost circuit including a boost inductor L2, a switch Q1, a boost diode D1 and a boost or output capacitor C2. The switch Q1 may be a MOSFET switch. The boost inductor L2 may include a transformer having a primary winding and an auxiliary winding. The primary winding of the boost inductor is coupled at one end to the input of the switched-mode power supply 804 and at the other end to the anode of the boost diode D1 and the drain of the switch Q1.

Operation of the switched-mode power supply 804 is controlled by boost controller circuitry 810, which is coupled to the output of the rectifier 802, the gate and source of the switch Q1, and the output of the switched-mode power supply 804. In addition, the boost controller circuitry 810 is coupled to the auxiliary winding of the boost inductor L2. However, the boost controller circuitry 810 may not draw bias or housekeeping power from the auxiliary winding of the boost inductor L2.

In one embodiment the boost controller, which may be implemented, for example, using a TPS92210 Single-Stage PFC Driver Controller for LED Lighting manufactured by Texas Instruments can be configured in a constant on time-boundary conduction mode. In this mode the switch Q1 is turned on for a fixed time ($T_{on}$) allowing for a ramp up of the current in the inductor L2. The switch Q1 is turned off and the inductor current ramps down to zero while supplying current to the output capacitor C2 through D1. The controller detects when the current falls to zero and initiates another turn-on of Q1. The peak input current in a switching period is given by given by $V_{in}*T_{on}/L$ which is proportional to $V_{in}$. Although the switching frequency varies over the line period, the average input current remains near sinusoidal and achieves a close to unity power factor.

In another embodiment, a boost controller, such as an L6562 PFC controller manufactured by STMicroelectronics, can be used in constant off-time continuous conduction mode. In this mode, the current reference for the switch current is obtained from the input waveform. The switch is operated with a fixed off time. In another embodiment, the average inductor current is sensed with a resistor and is controlled to follow the sinusoidal input voltage with a controller IC such as an IRF1155S manufactured by International Rectifier. Any of these controllers can be operated in constant power mode by operating them in open loop and fixing the controller reference, such as on-time or error-amplifier output, to a value that determines the power. The power transferred to the output is dumped into the load LEDs, which clamp the output voltage and in doing so define the output current.

Although a connection is shown from the auxiliary winding of L2 to the boost controller 810, a power factor compensating (PFC) boost converter for an LED driver circuit according to some embodiments may not draw bias or housekeeping power from the auxiliary winding of the boost converter. Rather, the boost controller may draw the auxiliary power from bottom of the LED string or from the drain node of the switch. Moreover, a PFC boost converter for an LED driver according to some embodiments may not use feedback from the LED voltage (VOUT) to control the converter.

The boost circuit 804 steps up the input voltage using basic components, which keeps the cost of the circuit low. Moreover, additional control circuitry can be minimal and the EMI filter 808 can be small. The boost circuit 804 achieves high efficiency by boosting the output voltage to a high level (for example about 170V or more). The load currents and circuit RMS currents can thereby be kept small, which reduces the resulting $I^2R$ losses. An efficiency of 93% can be achieved compared to 78-88% efficiency of a typical flyback or buck topology.

The boost converter 804 typically operates from 120V AC, 60 Hz (169 V peak) input and converts it to around 200V DC output. Different output voltages within a reasonable range (170V to 450V) can be achieved based on various circuit parameters and control methods while maintaining a reasonable performance. If a 230V AC input is used (such as conventional in Europe), the output may be 350V DC or higher.

In one embodiment the boost converter is driven in constant power mode in which the output LED current is determined by the LED voltage. In constant power mode, the boost controller circuitry may attempt to adjust the controller reference in response to changes in the input voltage so that the operating power remains constant. When operated in constant power mode, a power factor correcting boost voltage supply appears nearly as an incandescent/resistive load to the AC supply line or a phase cut dimmer. In case of a resistive load, the input current has the same shape as the input voltage, resulting in a power factor of 1. In constant power mode the power supply circuit 804 and light source 806 offer an equivalent resistance of approximately 1440Ω at the input, which means 10 W of power is drawn from the input at 120V AC. If the input voltage is dropped to 108V AC, the power will drop to approximately 8.1 W. As the AC voltage signal on the input line is chopped (e.g. by a phase cut dimmer), the power throughput gets reduced in proportion and the resulting light output by the light source 806 is dimmed naturally. Natural dimming refers to a method which does not require additional dimming circuitry. Other dimming methods need to sense the chopped rectified AC waveform and convert the phase-cut information to LED current reference or to a PWM duty cycle to the dim the LEDs. This additional circuitry adds cost to the system.

A boost converter according to some embodiments does not regulate the LED current or LED voltage in a feedback loop. That is, the boost converter may not use feedback from the LED voltage (VOUT) to control the converter. However both of these inputs could be used for protection such as over-voltage protection or over-current protection. Since the boost converter operates in open loop, it appears as a resistive input. When a PWM converter controls its output voltage or output current and when the input voltage is chopped with a dimmer, it will still try to control the output to a constant value and in the process increase the input current.

More details of circuits similar to the circuit 1400 are given in U.S. application Ser. No. 13/662,618 titled "DRIVING CIRCUITS FOR SOLID-STATE LIGHTING APPARTUS WITH HIGH VOLTAGE LED COMPONENTS AND RELATED METHODS," which is commonly owned with the present application by CREE, INC., which was filed on 29 Oct. 2012, and which is incorporated by reference as if fully set forth herein. Additional details regarding driver circuits are given in U.S. application Ser. No. 13/462,388 titled "DRIVER CIRCUITS FOR DIMMABLE SOLID STATE LIGHTING APPARATUS," which is commonly owned with the present application by CREE, INC., which was filed on 2 May 2012, and which is incorporated by reference as if fully set forth herein. Additional details regarding driver circuits are given in U.S. application Ser. No. 13/207,204 titled "BIAS VOLTAGE GENERATION USING A LOAD IN SERIES WITH A SWITCH," which is commonly owned with the present application by CREE, INC., which was filed on 10 Aug. 2011, and which is incorporated by reference as if fully set forth herein. Alternative power supplies that can be used are described in U.S. Pat. No. 8,476,836, titled "AC DRIVEN SOLID STATE LIGHTING APPARATUS WITH LED STRING INCLUDING SWITCHED SEGMENTS," which is incorporated herein by reference.

Figure 50:
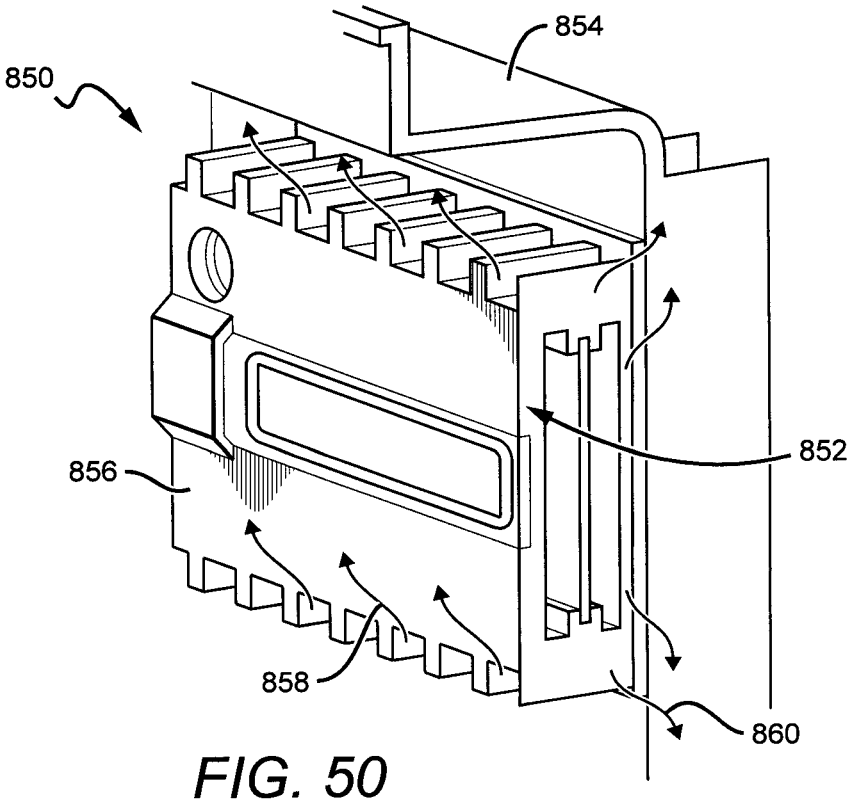
FIG. 50 is a perspective sectional view of the light fixture shown in FIG. 46.
Figure 51:
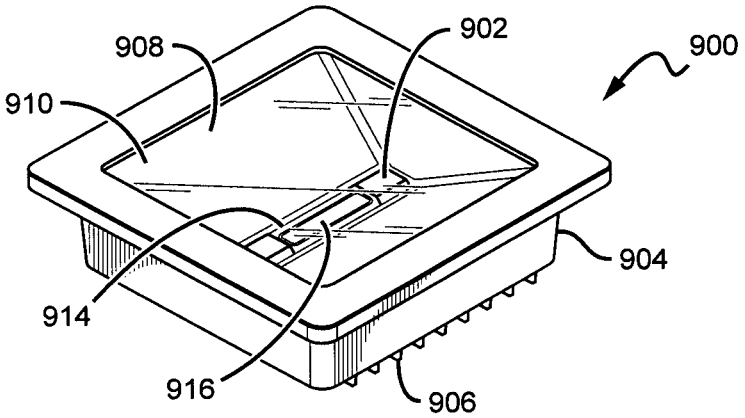
FIG. 51 is a top perspective view of a light fixture according to the present invention.
Figure 52:
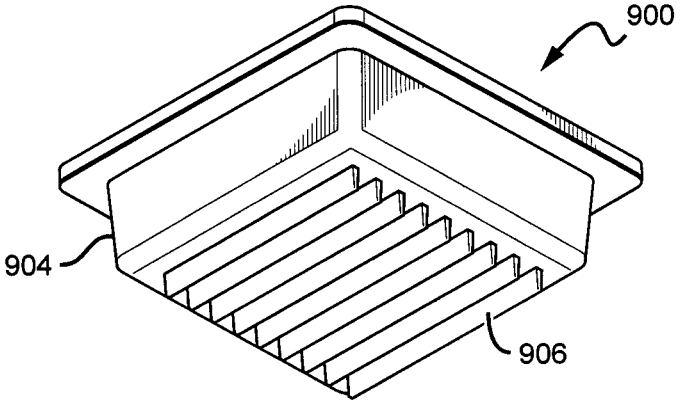
FIG. 52 is a bottom perspective view of the light fixture shown in FIG. 51.
Figure 53:
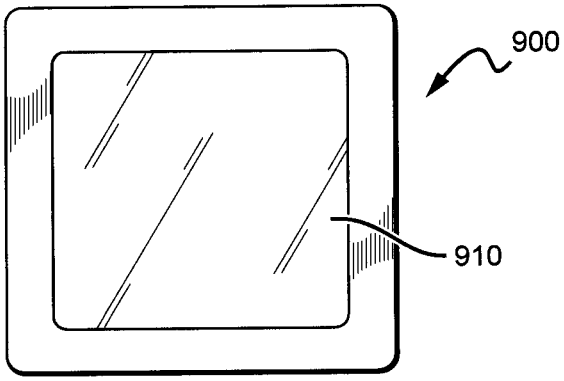
FIG. 53 is a top view of the light fixture shown in FIG. 51.
Figure 54:
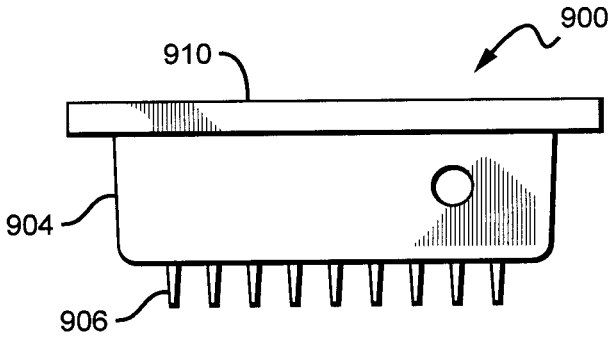
FIG. 54 is a side view of the light fixture shown in FIG. 51
Figure 57:
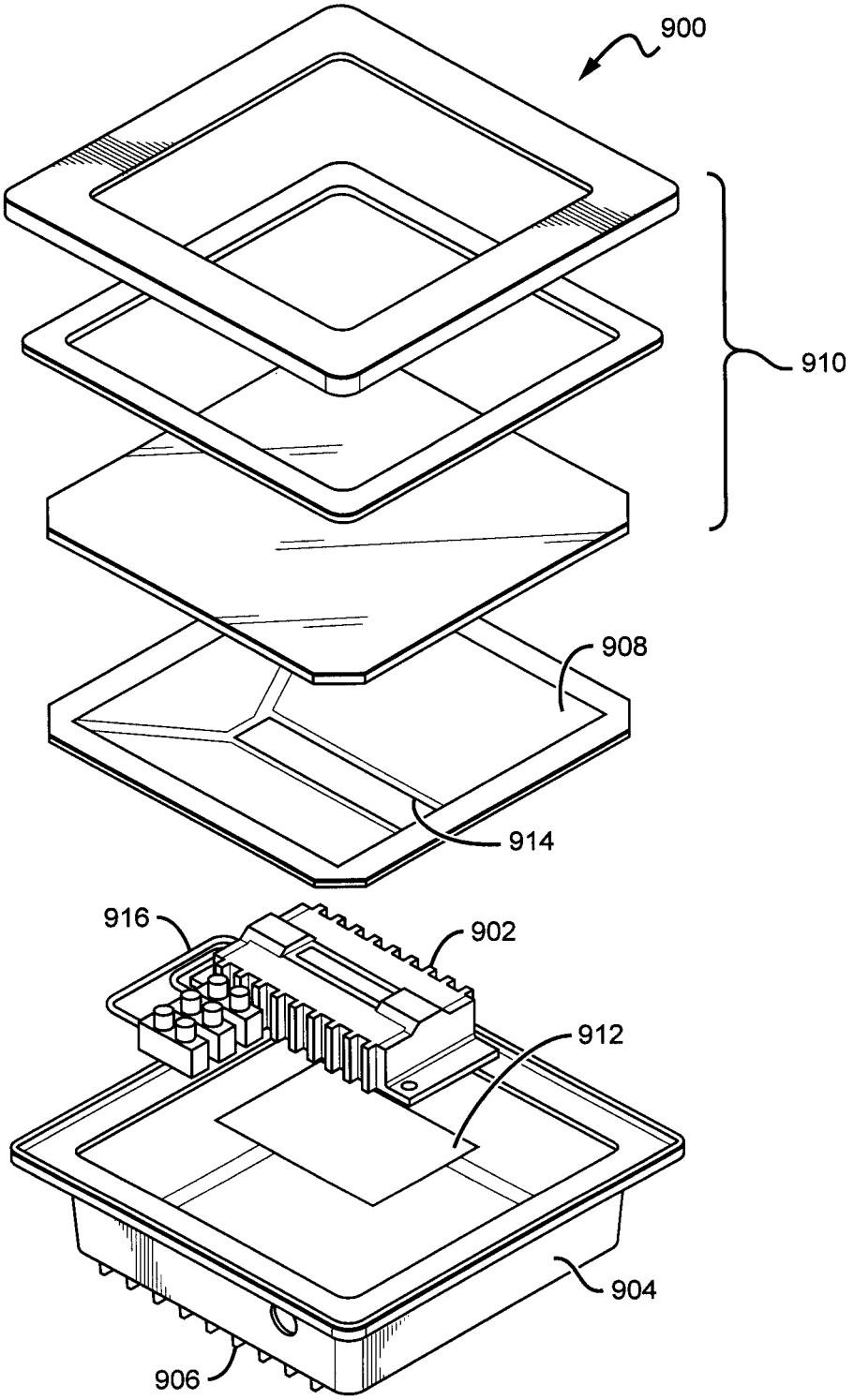
FIG. 57 is a sectional view of the light fixture shown in FIG. 51.

As mentioned above, the light engines according to the present invention can be utilized in different many different light fixtures according to the present invention, with the below embodiments showing only a sampling of these light fixtures. FIGS. 46-50 show one embodiment of a light fixture 850 according utilizing a light engine 852 according to the present invention any of the light engines described above can be used, with the light engine 852 arranged in the light fixture housing 854 in a horizontal orientation. The housing 854 can be arranged with back heat fins 857 to help radiate heat from the light engine 852. Referring now to FIG. 50, heat from the light engine 852 radiates through the light engine housing 856 where a portion radiates into the ambient around the light engine as shown by first arrows 858. Heat also conducts through the light engine housing 856 to the light fixture housing as shown by second arrows 860. This heat can than conduct throughout the light fixture housing 854, including the back heat fins 857, to radiate into the ambient around the light fixture 850.

FIGS. 54-57 show another embodiment of light fixture 900 according to the present invention that is similar to light fixture 850, and comprises a light engine 902 mounted in a light fixture housing 904, with the housing having heat radiating fins 906. The fixture further comprises a reflector 908 that can have angled surfaces to reflect light from the light engine 902. The light engine 902 can be arranged behind the reflector 908, and the reflector can have a cutout 914, with most of the light engine 902 not visible through the cutout 914. In some embodiments, the light engine's light source 916 is primarily visible through the cutout 014.

The light engine 900 can also comprise a transparent cover 910 (e.g. glass or plastic) over the housing opening, and a connector assembly for connecting an electrical signal to the light engine 902. The 900 fixture operates much in the same way as fixture 850, with heat from the light engine 902 radiating to the ambient around the light engine 902, and through the fixture housing 904 and housing fins 906 to the ambient around the fixture 900.

Different embodiments of the light fixture 900 can comprise a thermal interface between the light source engine 902 and the housing 904 to allow for efficient transfer of heat from the engine 902 to the housing 904. Some embodiments can comprise thermal mounting pad 912 that can be many different shapes, sizes and materials. In some embodiments the thermal mounting pad 912 can comprise double-sided thermal tape, thermal grease, or a metal to metal bond. Other types of mounting arrangements can comprise a screw or glue attachment with a thermally conductive filler between the engine 902 and the housing 904. Other embodiments can comprise thermal stand-offs, pins or compression springs.

FIGS. 58-62 show additional light fixtures according to the present invention. FIG. 58 shows an architectural wall mounted fixture 920 that can have a light engine emitting down. FIG. 59 shows a landscape light fixture 930 that can be used to illuminate landscaping or pathways. FIG. 60 shows a wall mounted light fixture 940 that can be mounted to an inside or outside wall. FIG. 61 shows a flood light 960, and FIG. 62 shows a decorative wall sconce, each of which can utilize light engines according to the present invention.

It is understood that embodiments presented herein are meant to be exemplary. Embodiments of the present invention can comprise any combination of compatible features shown in the various figures, and these embodiments should not be limited to those expressly illustrated and discussed. Although the present invention has been described in detail with reference to certain preferred configurations thereof, other versions are possible. Therefore, the spirit and scope of the invention should not be limited to the versions described above.

We claim:

1. A solid state light engine, comprising:

a substantially hollow light engine housing comprising a top surface and an opposing back surface which extends the full length and width of said housing;

a first end cap on a first end of said housing, said first end cap comprising a finger that extends over said top surface;

an elongated solid state light source on said top surface of said light engine housing, said housing at least partially comprising a thermally conductive material, said elongated light source in thermal contact with said housing, said back surface for mounting to a mount surface, wherein substantially all of said back surface is planar, said housing further comprising heat fins extending orthogonal to the plane of said back surface;

a power supply within said housing such that at least a portion of said housing is between said light source and said power supply; and an insulation sleeve within said housing and at least partially surrounding said power supply and arranged between said housing and said power supply, wherein said power supply converts a light engine input signal to a light source drive signal, said housing comprising a heat conducting path from said light source around said power supply, wherein said back surface is in thermal communication with said mount surface.

2. The light engine of claim 1, wherein said solid state light source comprises a plurality of LED chips serially interconnected on a submount.

3. The light engine of claim 1, wherein said solid state light source comprises a plurality of LED chips on a printed circuit board, at least some of said LED chips serially interconnected.

4. The light engine of claim 1, arranged for mounting in a light fixture housing, said housing surrounding said power supply and comprising a thermally conductive path extending between said power supply and a surface of said light fixture housing.

5. The light engine of claim 4, wherein heat from said elongated light source spreads to said light fixture housing through said light engine housing.

6. The light engine of claim 1, sized to be a J-type light source replacement.

7. The light engine of claim 1, further comprising a second end cap on a second end of said housing, said second end cap comprising a finger that extends over said top surface.

8. The light engine of claim 7, wherein each of said first and second end caps comprises a surface that is coplanar with said back surface.

9. The light engine of claim 8, wherein at least one of said first and second end caps comprises an electrical connection for accepting said light engine input signal.

10. The light engine of claim 7, wherein said light source comprises an elongated submount with first and second ends, wherein said finger of said first end cap is over said first end of said elongated submount, and wherein said finger of said second end cap is over said second end of said elongated submount.

11. The light engine of claim 1, wherein said insulation sleeve surrounds the majority of said power supply.

12. The light engine of claim 11, wherein said insulation sleeve provides electrical or thermal isolation between said power supply and said housing.

13. The light engine of claim 1, wherein said light engine input signal comprises a line voltage.

14. The light engine of claim 1, emitting light at an intensity of greater than 1000 lumens.

15. The light engine of claim 1, comprising an electrical connection at one end.

16. The light engine of claim 1, comprising electrical connections at opposing sides.

17. The light engine of claim 1, comprising electrical connections at opposing ends.

18. The light engine of claim 1, wherein said elongated solid state light source comprises a plurality of elongated light sources in proximity to one another.

19. The light engine of claim 18, wherein at least some of said plurality of elongated light sources are mounted end to end.

20. The light engine of claim 18, wherein at least some of said plurality of elongated light sources are side by side.

21. The light engine of claim 18, wherein at least some of said plurality of elongated light sources are mounted at angles to the top surface of said housing.

22. The light engine of claim 21, wherein at least some of said plurality of elongated light sources are mounted at different angles to said top surface.

23. The light engine of claim 21, wherein said light engine is mounted on a vertical mounting surface, with said heat fins arranged vertically.

24. The light engine of claim 1, wherein said light engine is a component of a solid state light fixture.

25. The light engine of claim 1, wherein said heat fins are vertical heat fins.

26. The light engine of claim 1, wherein said light source comprises a submount, and wherein said finger is at least partially over said submount.

27. A light engine, comprising:

a solid state light source on a thermally conductive light engine housing comprising opposing top and back surfaces, a finger over said top surface, and opposing longitudinal side surfaces, said light source in thermal contact with said top surface of said housing, said housing comprising a back surface for mounting said light engine to a mount surface, wherein substantially all of said back surface is planar, said housing further comprising heat fins, wherein said heat fins are an integral part of said housing and form said opposing longitudinal side surfaces and at least part of said back surface; and a power supply internal to said housing and between said light source and said mount surface wherein said housing surrounds the majority of said power supply, said housing comprising a heat conducting path around said power supply to said mount surface, wherein said back surface is in thermal communication with said mount surface; and a thermal or electrical insulation material between said power supply and said housing.

28. The light engine of claim 27, wherein said housing at least partially surrounds said power supply.

29. The light engine of claim 27, wherein said mount surface is part of a light fixture.

30. The light engine of claim 27, wherein said power supply converts a light engine input signal to a light source drive signal.

31. The light engine of claim 27, sized to be a J-type light source replacement.

32. The light engine of claim 27, wherein said insulation material comprises an insulation sleeve in said housing and at least partially around said power supply.

33. The light engine of claim 27, emitting light at an intensity of greater than 1000 lumens.

34. The light engine of claim 27, wherein said light source has a length to width ratio greater than 3 to 1.

35. The light engine of claim 27, wherein said heat fins are vertical heat fins.

36. A bulb replacement solid state light engine, comprising:

a substantially hollow thermally conductive rectangular light engine housing comprising a top surface and an opposing back surface which extends the full length and width of said housing, said top surface comprising a channel;

a finger that extends at least partially over said channel;

a solid state light source at least partially in said channel, said light source in thermal contact with said housing, wherein said light source has a length to width ratio greater than 3 to 1, said back surface for mounting said light engine to a mount surface, wherein substantially all of said back surface is planar, said housing further comprising heat fins, wherein said heat fins form part of said back surface; and a power supply internal to said housing, with an insulating material between said power supply and said housing such that said housing comprising a heat conducting path around said power supply to said mount surface, wherein said back surface is in thermal communication with said mount surface.

37. The light engine of claim 36, comprising a J-type bulb replacement.

38. The light engine of claim 36, emitting light with a CRI of 70 or more.

39. The light engine of claim 36, emitting light with a correlated color temperature in the range of 2700 to 10,000K.

40. The light engine of claim 36, having an efficacy of 90 lumens per watt or more.

41. The light engine of claim 36, wherein said heat fins are vertical heat fins.

* * * * *